US011015411B2

(12) United States Patent
Tesla

(10) Patent No.: US 11,015,411 B2
(45) Date of Patent: May 25, 2021

(54) SYSTEMS AND METHODS FOR RETRIEVABLE HYDRAULIC QUICK DUMP RETROFIT MODULES FOR ELECTRO-HYDRAULIC SUBSEA PRODUCTION SYSTEMS

(71) Applicant: Marlon J. Tesla, Houston, TX (US)

(72) Inventor: Marlon J. Tesla, Houston, TX (US)

( * ) Notice: Subject to any disclaimer, the term of this patent is extended or adjusted under 35 U.S.C. 154(b) by 0 days.

(21) Appl. No.: 16/708,017

(22) Filed: Dec. 9, 2019

(65) Prior Publication Data

US 2020/0182004 A1 Jun. 11, 2020

Related U.S. Application Data

(60) Provisional application No. 62/777,168, filed on Dec. 9, 2018.

(51) Int. Cl.

| | |
|---|---|
| ***E21B 33/035*** | (2006.01) |
| ***E21B 33/038*** | (2006.01) |
| *E21B 34/16* | (2006.01) |
| *E21B 43/013* | (2006.01) |
| *E21B 41/00* | (2006.01) |
| *E21B 34/04* | (2006.01) |

(52) U.S. Cl.

CPC ..... *E21B 33/0355* (2013.01); *E21B 33/038* (2013.01); *E21B 34/04* (2013.01); *E21B 34/16* (2013.01); *E21B 41/0007* (2013.01); *E21B 43/013* (2013.01); *E21B 2200/04* (2020.05)

(58) Field of Classification Search

CPC .... E21B 33/0355; E21B 33/038; E21B 34/04; E21B 34/16

See application file for complete search history.

(56) References Cited

U.S. PATENT DOCUMENTS

| | | | | |
|---|---|---|---|---|
| 4,817,669 | A * | 4/1989 | Barrier | E21B 33/0355 137/236.1 |
| 7,757,772 | B2 * | 7/2010 | Donohue | E21B 33/0355 166/344 |
| 10,119,352 | B2 | 11/2018 | Holmes et al. | |
| 2011/0114329 | A1 * | 5/2011 | Emecheta | E21B 33/0355 166/350 |
| 2017/0159394 | A1 * | 6/2017 | Kalinec | E21B 33/064 |

FOREIGN PATENT DOCUMENTS

| | | | | |
|---|---|---|---|---|
| GB | 2557995 | A * | 7/2018 | E21B 33/0355 |

* cited by examiner

*Primary Examiner* — Matthew R Buck
(74) *Attorney, Agent, or Firm* — Holland & Hart LLP

(57) ABSTRACT

A retrievable and retrofittable subsea hydraulic dump valve assembly for a subsea oil and gas production system including at least one hydraulic selector valve including a solenoid and a spring. The hydraulic selector valve converts a first hydraulic pressure supply line into a primary hydraulic pressure supply line and a second hydraulic pressure supply line into a pilot line and a backup hydraulic pressure supply line. In a first operating configuration the hydraulic selector valve channels a first flow of hydraulic fluid from the first hydraulic pressure supply line to the critical control valve actuators to maintain the critical control valve actuators in the open configuration. In a second operating configuration the hydraulic selector valve channels the flow of hydraulic fluid to the subsea environment at a local venting location to reconfigure the critical control valve actuators into a closed configuration.

20 Claims, 10 Drawing Sheets

SYSTEMS AND METHODS FOR RETRIEVABLE HYDRAULIC QUICK DUMP RETROFIT MODULES FOR ELECTRO-HYDRAULIC SUBSEA PRODUCTION SYSTEMS

CROSS-REFERENCE TO RELATED APPLICATIONS

This application claims priority to U.S. Provisional Patent Application No. 62/777,168, filed Dec. 9, 2018, which is incorporated herein by reference in its entirety.

BACKGROUND

The field of the disclosure relates generally to hydraulic distribution manifolds for controlling valves and, more particularly, to a retrievable and retrofittable subsea hydraulic dump valve assembly for controlling valves in subsea oil and gas production facilities.

Subsea oil and gas production generally involves drilling and operating wells to locate and retrieve hydrocarbons. Subsea trees are positioned at well sites in relatively deep water and produce oil and gas which is channeled to surface facilities for further processing. Subsea oil and gas production systems typically include valves, such as, but not limited to, control valves, shut-off valves, and/or blowout preventers, that are commonly used in subsea oil and gas production systems to control the flow of oil and gas from the subsea trees. Safety shut-off systems typically include a remotely controlled valve or set of valves (i.e. control valves, shut-off valves, and/or blowout preventers) that can shut off subsea trees in the event of an unanticipated loss of communication with the subsea trees.

More specifically, modern deep water subsea production systems used for oil and gas production from subsea trees include valves, such as, but not limited to control valves and shut-off valves, that are hydraulically held opened against a failsafe close hydraulic actuator or held closed with a failsafe open hydraulic actuator. The opening and closing of the valves is controlled by a Subsea Control Module (SCM) that electrically controls small valves called Directional Control Valves (DCV) which route hydraulic power to the valve actuator to act against a spring to open the valve. Hydraulic pressure is exhausted by the DCV to allow the valve to close. The DCVs are electrically pulsed by the SCM to open and pulsed again to close. Once a DCV is pulsed open, the hydraulic pressure latches the DCV in the open configuration allowing it to remain in the open configuration even if electric power to the SCM is lost. The DCV will not close until pulsed again after receiving a signal from the surface facility. The SCM's electronics relay valve status, such as pressure and temperature, back to the surface facility so that the wells can be monitored and controlled. The surface facility provides hydraulic power through a subsea umbilical and distribution system to the subsea tree and SCM. The surface facility typically provides redundant hydraulic supplies to the SCM of which one is used for valve control. A hydraulic selector valve positioned within the SCM is used to select which hydraulic supply is used for actuating the valves while blocking the redundant hydraulic supply from actuating the valves and preventing cross communication between the two hydraulic supplies. If the electrical communication system fails between the surface facility and the SCM, the valves may be closed by venting the hydraulic supplies from the surface facility.

As subsea wells are installed further away from the surface facility, the length of the hydraulic supply lines and electrical conduits increases. As such, the time required to fully shut in a well through bleed back of hydraulic fluid increases because of frictional losses in the hydraulic supply lines back to the surface facility. Additionally, regulatory bodies for offshore oil and gas production facilities typically impose maximum closure times for closure of critical safety valves in emergency situations. Long step outs from the surface facilities pose challenges in meeting these times in the event of a loss of communications. Operators typically request exceptions to these requirements or agree to proactively shut in wells if communications is lost, preventing the operator from troubleshooting the root cause of the communication loss while continuing production of the well. The inability to continuing production of the well while troubleshooting poses significant risks and financial implications for the operator. It would therefore be desirable to be able to quickly close critical safety valves using a hydraulic system in the event of loss of communications between the surface facility and the well in order to be allowed to continue to produce oil and gas should electrical communications be lost.

BRIEF DESCRIPTION

One aspect of the present disclosure includes a retrievable and retrofittable subsea hydraulic dump valve assembly for a subsea oil and gas production system. The subsea oil and gas production system includes a first hydraulic pressure supply line, a second hydraulic pressure supply line, a plurality of critical control valve actuators, and a Subsea Control Module (SCM) hydraulic selector valve. The first hydraulic pressure supply line and the second hydraulic pressure supply line each channel a flow of hydraulic fluid to the SCM hydraulic selector valve. The SCM hydraulic selector valve selects one of the first hydraulic pressure supply line and the second hydraulic pressure supply line to channel the flow of hydraulic fluid to the critical control valve actuators to maintain the critical control valve actuators in an open configuration. The unselected hydraulic pressure supply line is a backup hydraulic pressure supply line for the critical control valve actuators. The critical control valve actuators are reconfigured into a closed configuration within a first reconfiguration time by depressurizing the first hydraulic pressure supply line and the second hydraulic pressure supply line. The retrievable and retrofittable subsea hydraulic dump valve assembly includes at least one hydraulic selector valve including a solenoid and a spring. The hydraulic selector valve converts the first hydraulic pressure supply line into a primary hydraulic pressure supply line and the second hydraulic pressure supply line into a pilot line and the backup hydraulic pressure supply line. The second hydraulic pressure supply line channels a second flow of hydraulic fluid to the solenoid to reconfigure the hydraulic selector valve between a first operating configuration and a second operating configuration. In the first operating configuration the hydraulic selector valve channels a first flow of hydraulic fluid from the first hydraulic pressure supply line to the critical control valve actuators to maintain the critical control valve actuators in the open configuration. In the second operating configuration the hydraulic selector valve channels the flow of hydraulic fluid to the subsea environment at a local venting location to reconfigure the critical control valve actuators into a closed configuration. The retrievable and retrofittable subsea hydraulic dump valve assembly reconfigures the critical control valve actuators from the open configuration to the closed configuration within a second reconfiguration time less than the first reconfiguration time. In the first operating configuration the second hydraulic pressure supply line channels the second flow of hydraulic fluid to the solenoid and a hydraulic pressure of the second flow of hydraulic fluid acts on the spring to configure the hydraulic selector valve in the first operating configuration. In the second operating configuration the hydraulic pressure of the second flow of hydraulic fluid is reduced such that the spring reconfigures the hydraulic selector valve in the second operating configuration.

Another aspect of the present disclosure includes a subsea oil and gas production system including a surface facility, an umbilical, and a subsea production system. The umbilical includes a first end coupled to the surface facility, a first hydraulic pressure supply line, and a second hydraulic pressure supply line. The subsea production system includes at least one subsea tree, a Subsea Control Module (SCM) hydraulic selector valve, and a retrievable and retrofittable subsea hydraulic dump valve assembly. The subsea tree is coupled to the hydraulic distribution manifold and includes at least one critical control valve actuator configured to control the flow of oil and gas from a well. The first hydraulic pressure supply line and the second hydraulic pressure supply line each channel a flow of hydraulic fluid to the SCM hydraulic selector valve. The SCM hydraulic selector valve selects one of the first hydraulic pressure supply line and the second hydraulic pressure supply line to channel the flow of hydraulic fluid to the critical control valve actuators to maintain the critical control valve actuators in an open configuration. The unselected hydraulic pressure supply line is a backup hydraulic pressure supply line for the critical control valve actuators. The critical control valve actuators are reconfigured into a closed configuration within a first reconfiguration time by depressurizing the first hydraulic pressure supply line and the second hydraulic pressure supply line. The retrievable and retrofittable subsea hydraulic dump valve assembly includes at least one hydraulic selector valve including a solenoid. The hydraulic selector valve converts the first hydraulic pressure supply line into a primary hydraulic pressure supply line and the second hydraulic pressure supply line into a pilot line and the backup hydraulic pressure supply line. The second hydraulic pressure supply line channels a second flow of hydraulic fluid to the solenoid to reconfigure the hydraulic selector valve between a first operating configuration and a second operating configuration. In the first operating configuration the hydraulic selector valve channels a first flow of hydraulic fluid from the first hydraulic pressure supply line to the critical control valve actuators to maintain the critical control valve actuators in the open configuration. In the second operating configuration the hydraulic selector valve channels the flow of hydraulic fluid to the subsea environment at a local venting location to reconfigure the critical control valve actuators into a closed configuration. The retrievable and retrofittable subsea hydraulic dump valve assembly reconfigures the critical control valve actuators from the open configuration to the closed configuration within a second reconfiguration time less than the first reconfiguration time.

Yet another aspect of the present disclosure includes a retrievable and retrofittable subsea hydraulic dump valve assembly for a subsea oil and gas production system. The subsea oil and gas production system includes a first hydraulic pressure supply line, a second hydraulic pressure supply line, a plurality of critical control valve actuators, and a Subsea Control Module (SCM) hydraulic selector valve. The first hydraulic pressure supply line and the second hydraulic pressure supply line each channel a flow of hydraulic fluid to the SCM hydraulic selector valve. The SCM hydraulic selector valve selects one of the first hydraulic pressure supply line and the second hydraulic pressure supply line to channel the flow of hydraulic fluid to the critical control valve actuators to maintain the critical control valve actuators in an open configuration. The unselected hydraulic pressure supply line is a backup hydraulic pressure supply line for the critical control valve actuators. The critical control valve actuators are reconfigured into a closed configuration within a first reconfiguration time by depressurizing the first hydraulic pressure supply line and the second hydraulic pressure supply line. The retrievable and retrofittable subsea hydraulic dump valve assembly includes a first hydraulic selector valve, a second hydraulic selector valve, a first isolation valve, and a second isolation valve. The first hydraulic selector valve includes a first solenoid and a first spring. The second hydraulic pressure supply line is coupled to the first hydraulic selector valve. The second hydraulic selector valve including a second solenoid and a second spring. The first hydraulic pressure supply line is coupled to the second hydraulic selector valve. The first isolation valve is coupled to the first hydraulic pressure supply line and an inlet of the first hydraulic selector valve. In a first operating configuration the first hydraulic pressure supply line channels a first flow of hydraulic fluid to the first isolation valve and to the second solenoid and the first isolation valve channels the first flow of hydraulic fluid to the inlet of the first hydraulic selector valve. In a second operating configuration the first isolation valve prevents the first flow of hydraulic fluid from flowing to the inlet of the first hydraulic selector valve. The second isolation valve is coupled to the second hydraulic pressure supply line and an inlet of the second hydraulic selector valve. In the second operating configuration the second hydraulic pressure supply line channels a second flow of hydraulic fluid to the second isolation valve and to the first solenoid and the second isolation valve channels the second flow of hydraulic fluid to the inlet of the second hydraulic selector valve. In the first operating configuration the second isolation valve prevents the second flow of hydraulic fluid from flowing to the inlet of the second hydraulic selector valve. At least one of the first and second hydraulic selector valves converts at least one of the first and second hydraulic pressure supply lines into a primary hydraulic pressure supply line. At least one of the first and second hydraulic selector valves converts at least one of the first and second hydraulic pressure supply lines into a pilot line and a backup hydraulic pressure supply line. The second hydraulic pressure supply line channels the second flow of hydraulic fluid to the first solenoid to reconfigure the first hydraulic selector valve between the first operating configuration and the second operating configuration. The first hydraulic pressure supply line channels the first flow of hydraulic fluid to the second solenoid to reconfigure the second hydraulic selector valve between the first operating configuration and the second operating configuration. In the first operating configuration the first hydraulic selector valve channels the first flow of hydraulic fluid from the first hydraulic pressure supply line to the subsea environment at a local venting location to reconfigure the critical control valve actuators into a closed configuration when the first and second hydraulic pressure supply lines are depressurized. In the second operating configuration the second hydraulic selector valve channels the second flow of hydraulic fluid from the second hydraulic pressure supply line to the subsea environment at a local venting location to reconfigure the critical control valve actuators into the closed configuration when the first and second hydraulic pressure supply lines are depressurized. The retrievable and retrofittable subsea hydraulic dump valve assembly reconfigures the critical control valve actuators from the open configuration to the closed configuration within a second reconfiguration time less than the first reconfiguration time. In the first operating configuration the second hydraulic pressure supply line channels the second flow of hydraulic fluid to the first hydraulic selector valve and a hydraulic pressure of the second flow of hydraulic fluid acts on the first spring to configure the first hydraulic selector valve in the first operating configuration. In the second operating configuration the hydraulic pressure of the second flow of hydraulic fluid is reduced such that the first spring reconfigures the first hydraulic selector valve in the second operating configuration. In the second operating configuration the first hydraulic pressure supply line channels the first flow of hydraulic fluid to the second solenoid and a hydraulic pressure of the first flow of hydraulic fluid acts on the second spring to configure the second hydraulic selector valve in the second operating configuration. In the first operating configuration the hydraulic pressure of the first flow of hydraulic fluid is reduced such that the second spring reconfigures the second hydraulic selector valve in the first operating configuration.

DRAWINGS

These and other features, aspects, and advantages of the present disclosure will become better understood when the following detailed description is read with reference to the accompanying drawings in which like characters represent like parts throughout the drawings, wherein.

Figure 1:
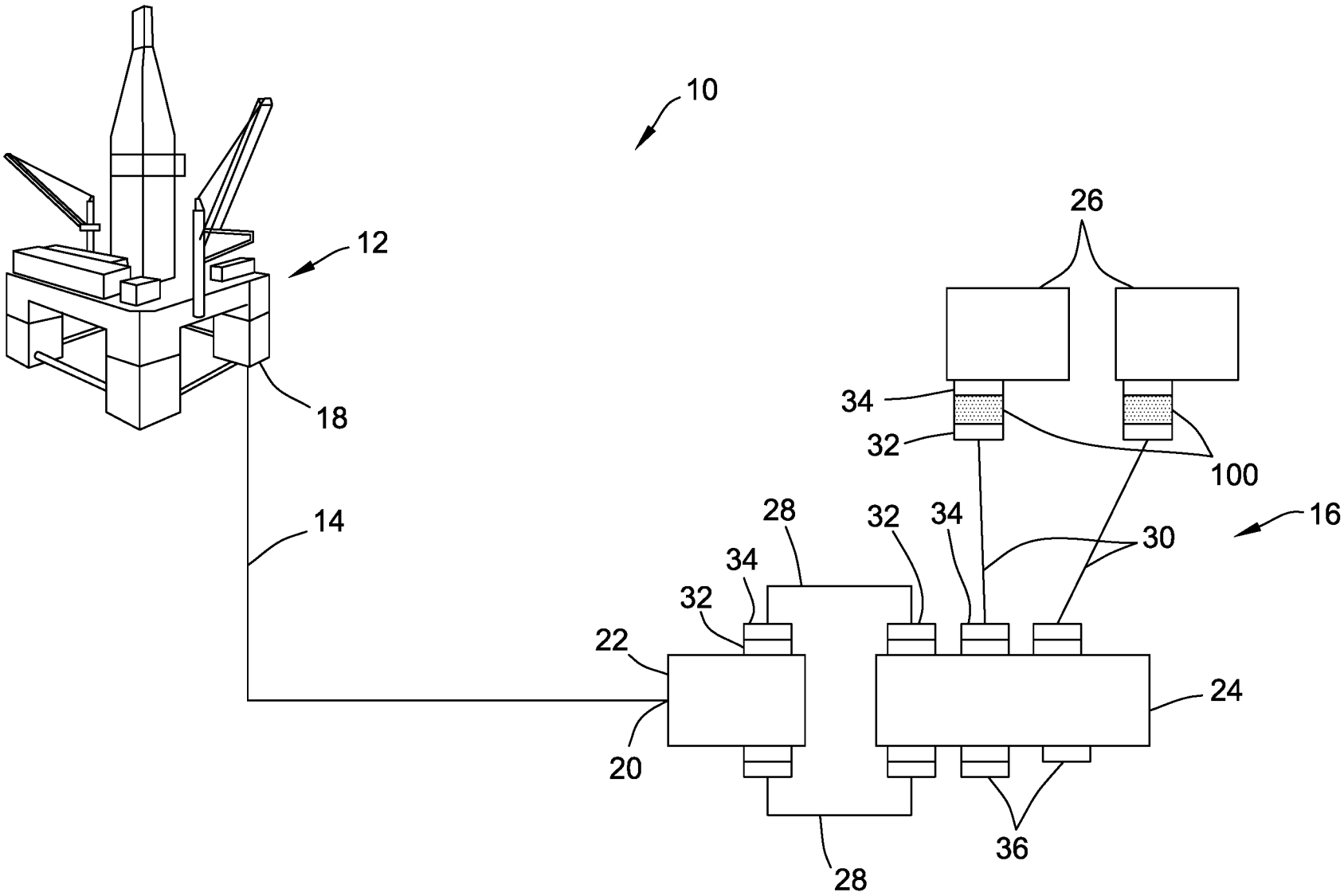
FIG. 1 is a block diagram of an exemplary subsea oil and gas production system including a retrievable and retrofittable subsea hydraulic dump valve assembly in the form of a sandwich plate between a tree steel flying lead (SFL) and the production tree.
Figure 3:
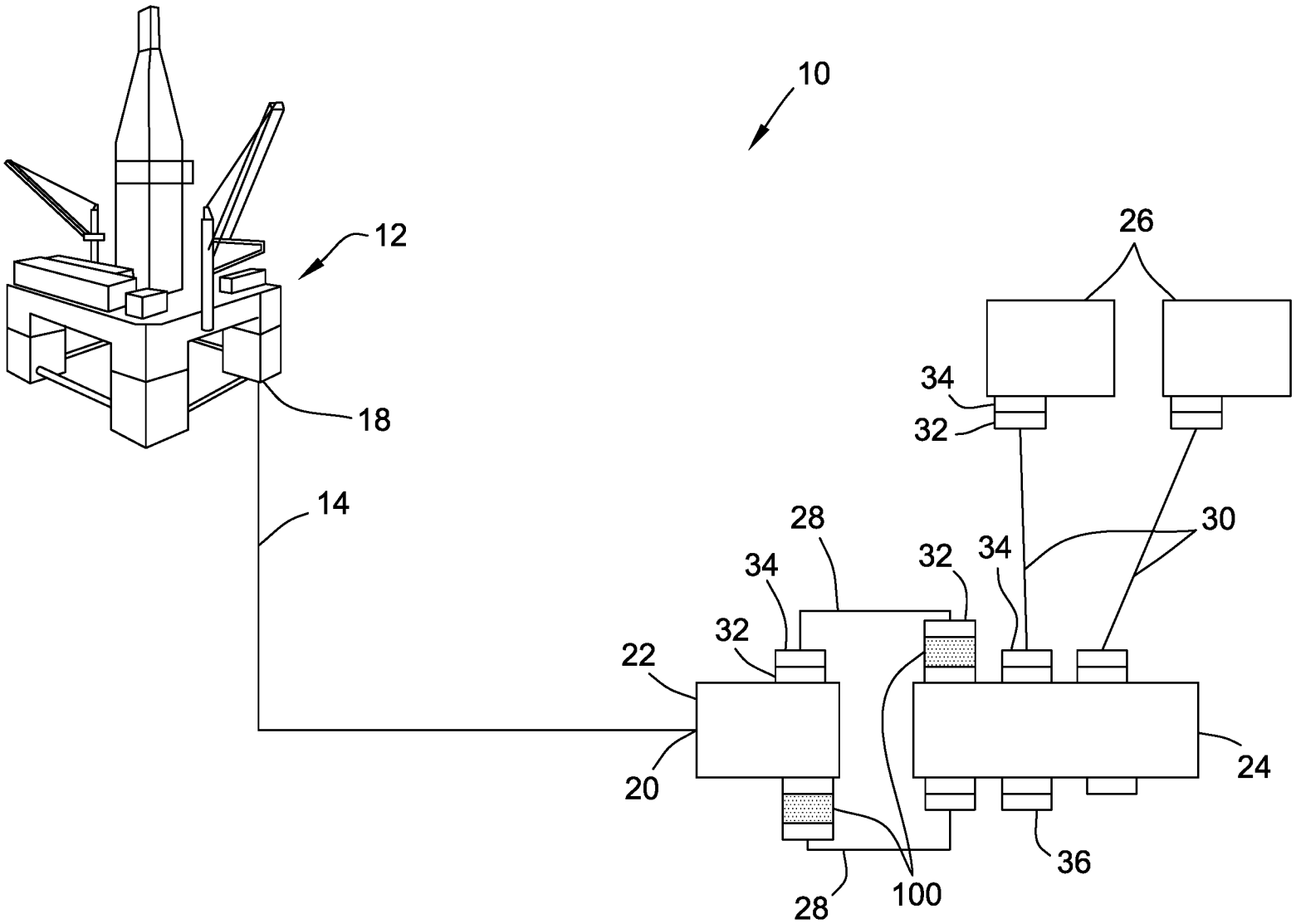

FIG. 3 is a schematic illustration of the exemplary subsea oil and gas production system of FIG. 1 illustrating an alternative location of the retrievable and retrofittable subsea hydraulic dump valve assembly in the form of a sandwich plate between the umbilical termination head UTH and a SFL leading into the HDM allowing the retrievable and retrofittable subsea hydraulic dump valve assembly to exhaust fluid to all components downstream of it.

Figure 4:
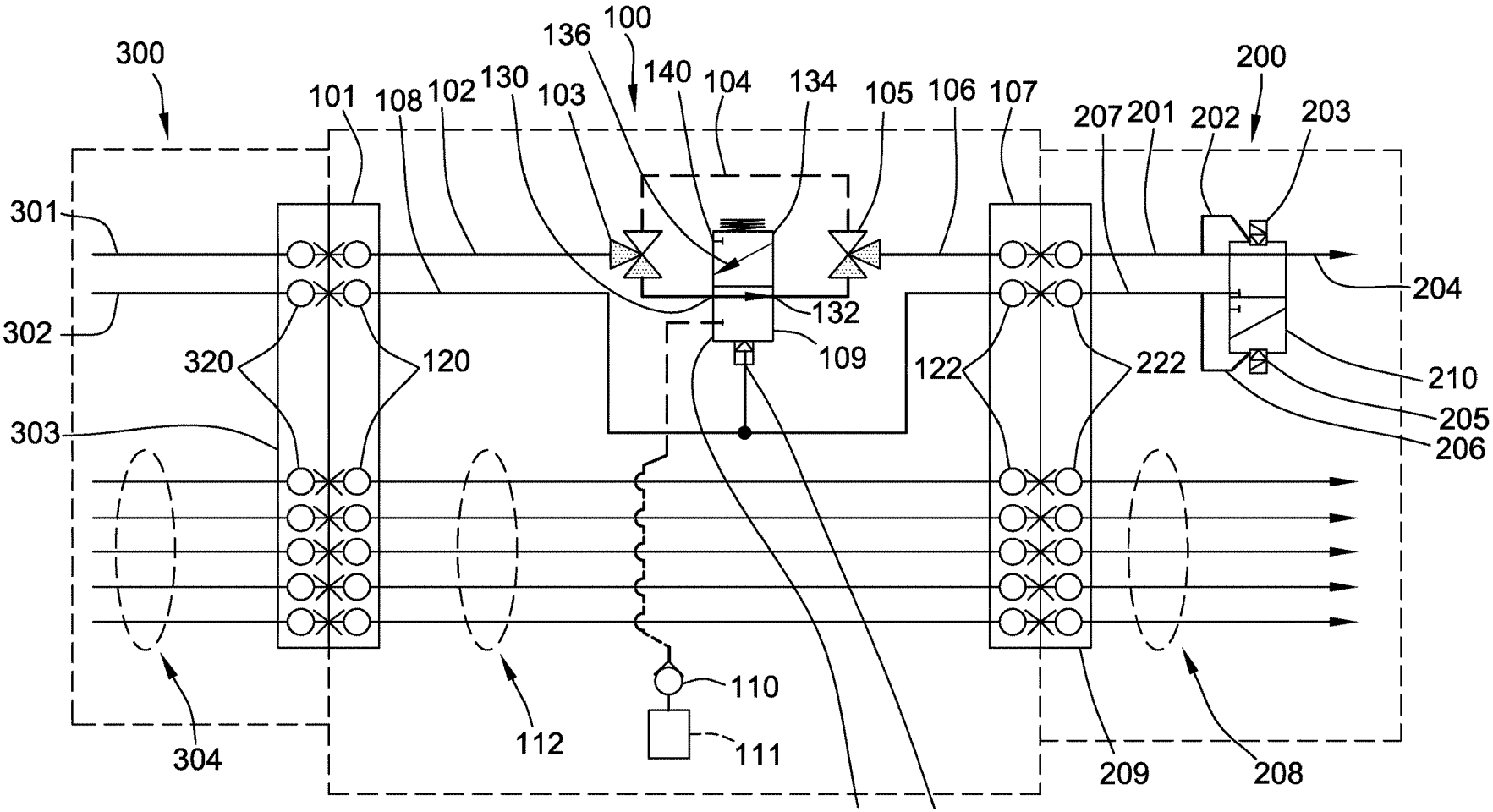

FIG. 4 is a schematic illustration of an exemplary retrievable and retrofittable subsea hydraulic dump valve assembly in the form of a sandwich plate shown in FIG. 1 in a first operating configuration.

Figure 5:
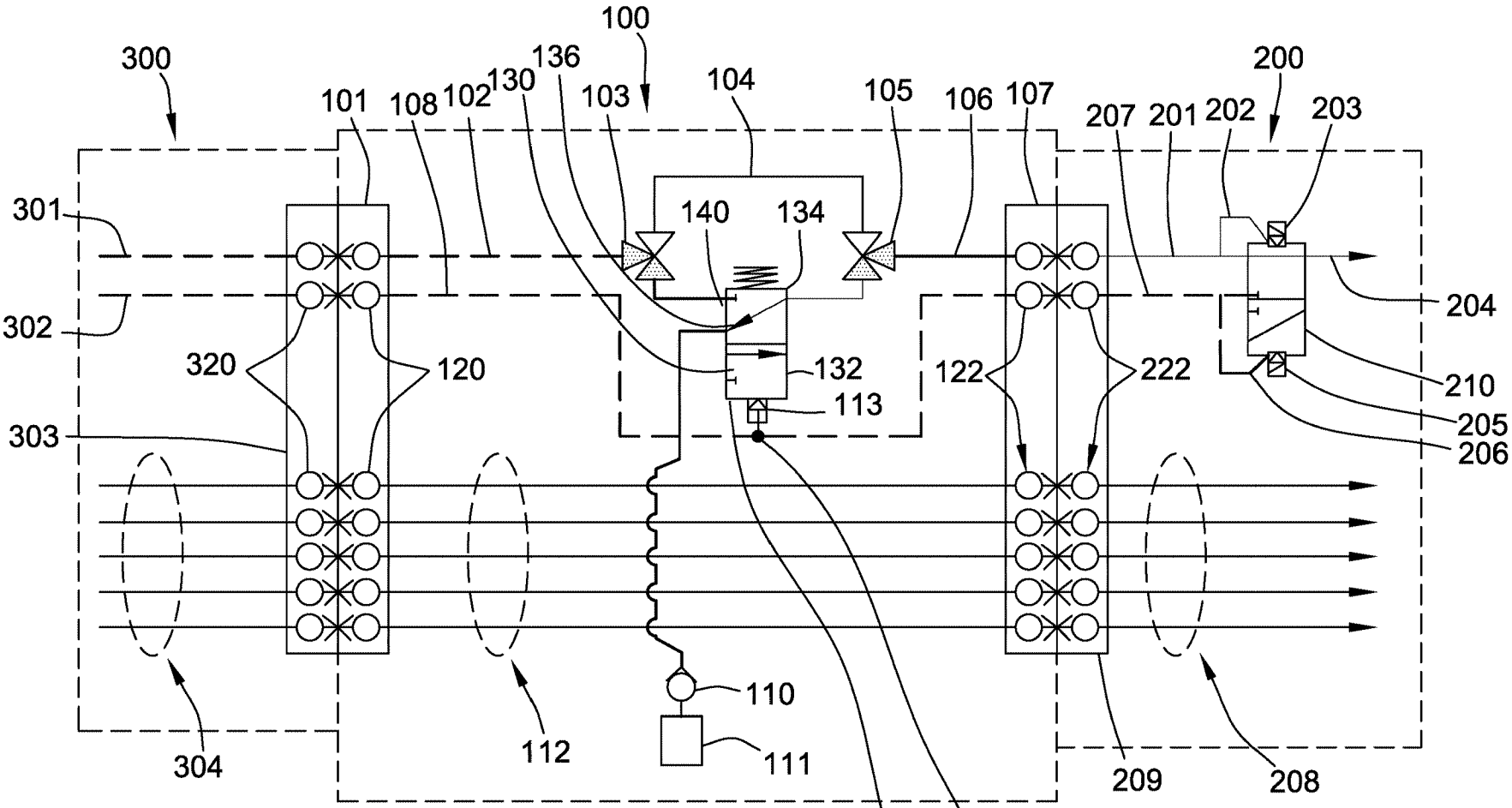

FIG. 5 is a schematic illustration of the exemplary retrievable and retrofittable subsea hydraulic dump valve assembly shown in FIG. 4 in a second operating configuration.

Figure 6:
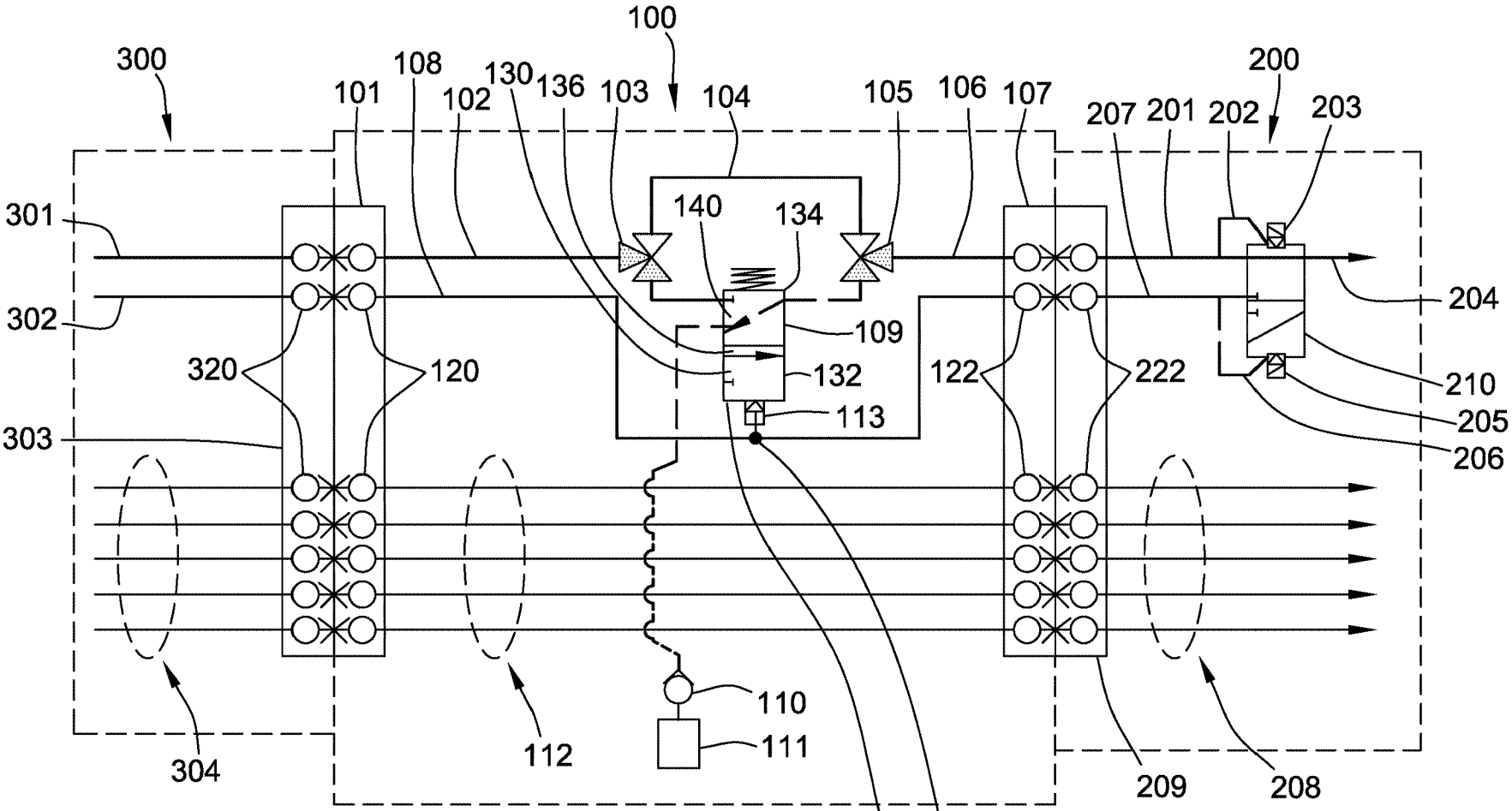

FIG. 6 is a schematic illustration of the exemplary retrievable and retrofittable subsea hydraulic dump valve assembly shown in FIG. 4 in a third operating configuration.

Figure 2:
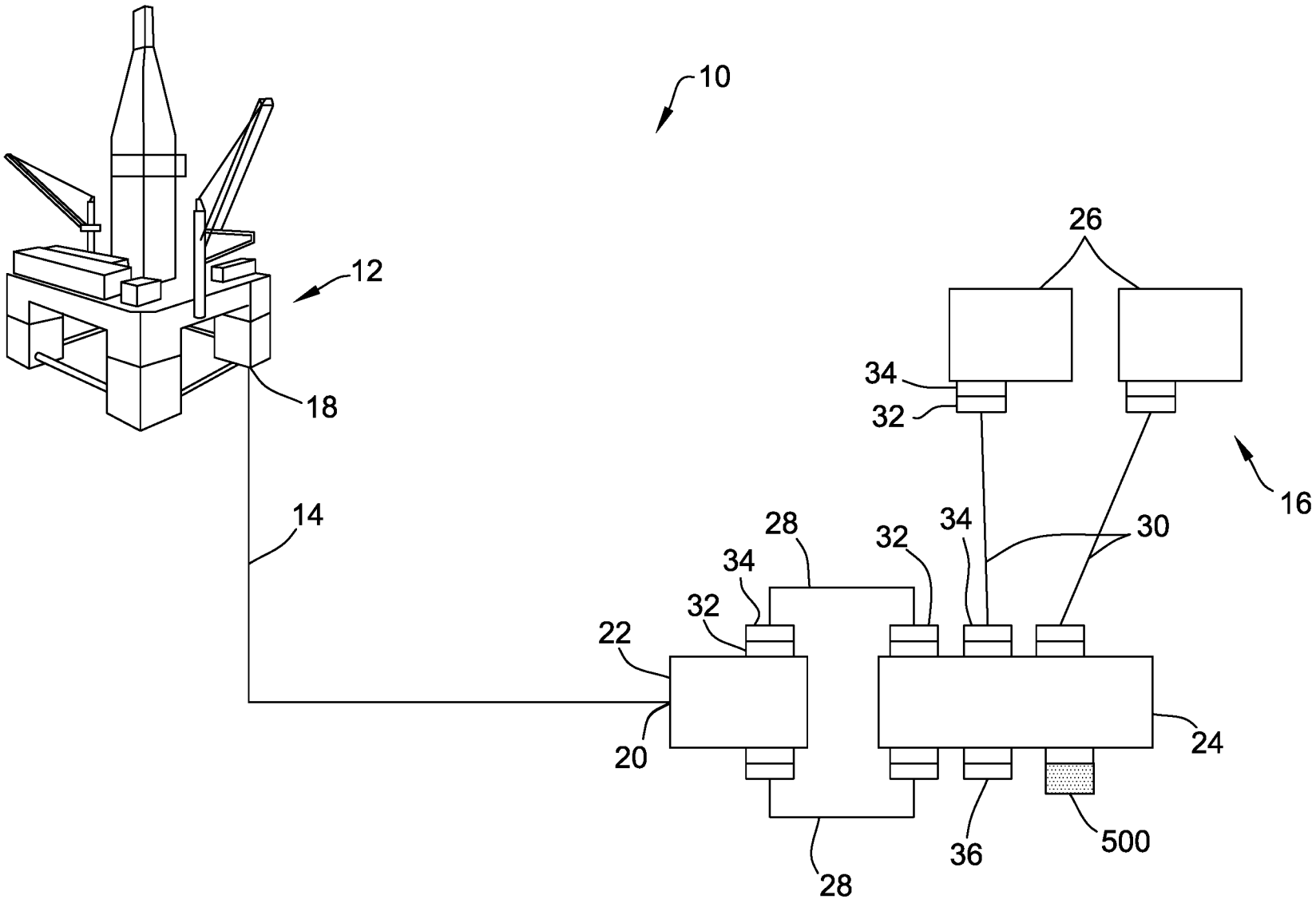
FIG. 2 is a block diagram of the exemplary subsea oil and gas production system of FIG. 1 illustrating an alternative location of the retrievable and retrofittable subsea hydraulic dump valve assembly in the form of an external logic cap that is installed on a hydraulic distribution manifold (HDM) allowing it to exhaust pressure on the entire hydraulic circuit.
Figure 7:
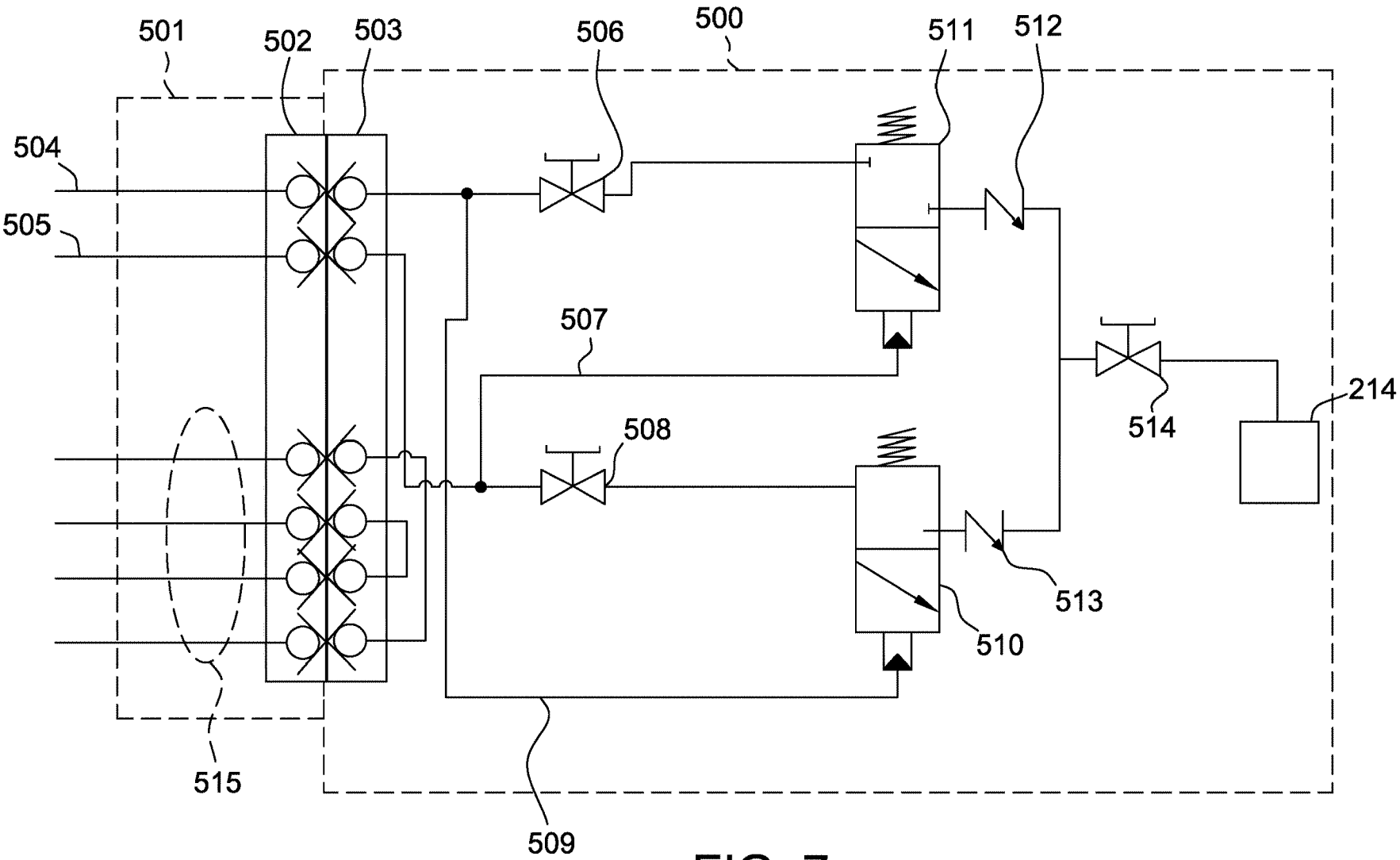

FIG. 7 is a schematic illustration of an alternative embodiment of the retrievable and retrofittable subsea hydraulic dump valve assembly in the form of an external logic cap assembly shown in FIG. 2.

Figure 8:
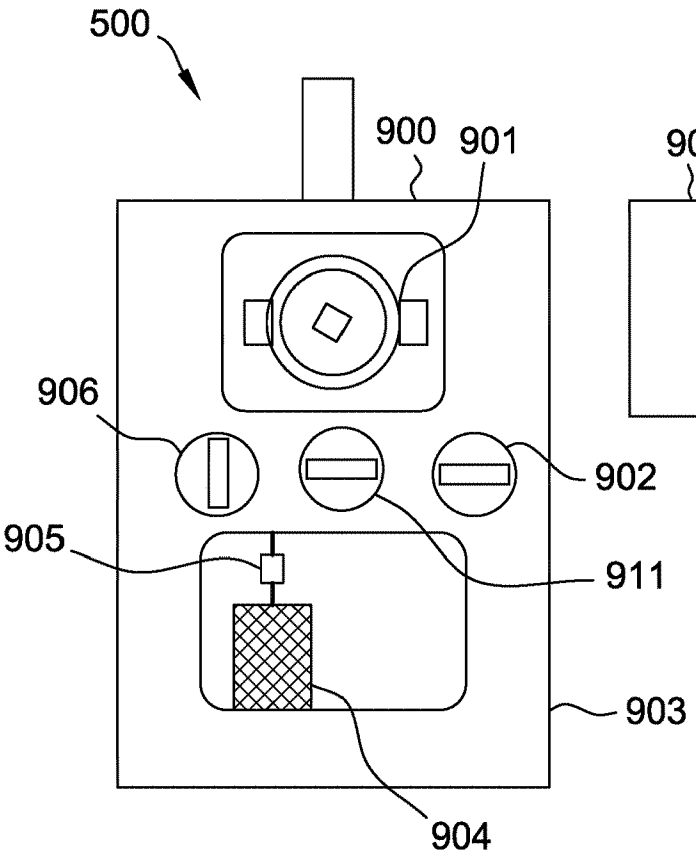

FIG. 8 is a back schematic view of the exemplary logic cap plate assembly shown in FIG. 7.

Figure 9:
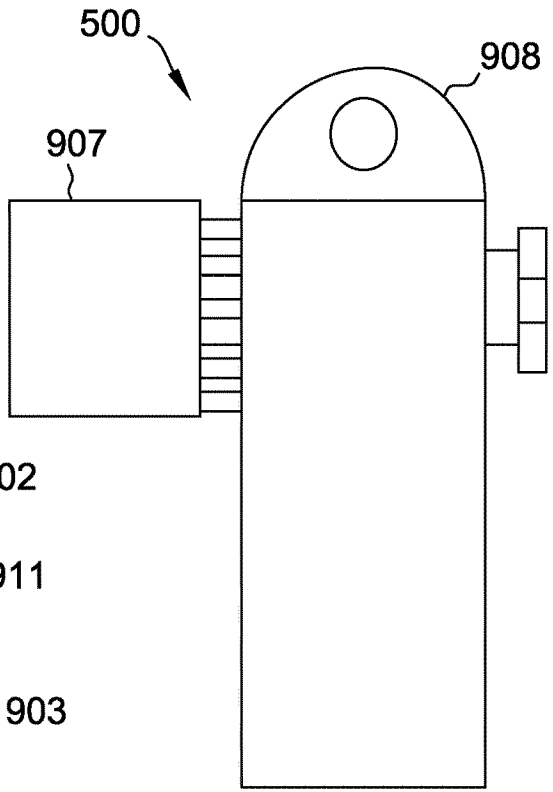

FIG. 9 is a side schematic view of the exemplary logic cap plate assembly shown in FIG. 7.

Figure 10:
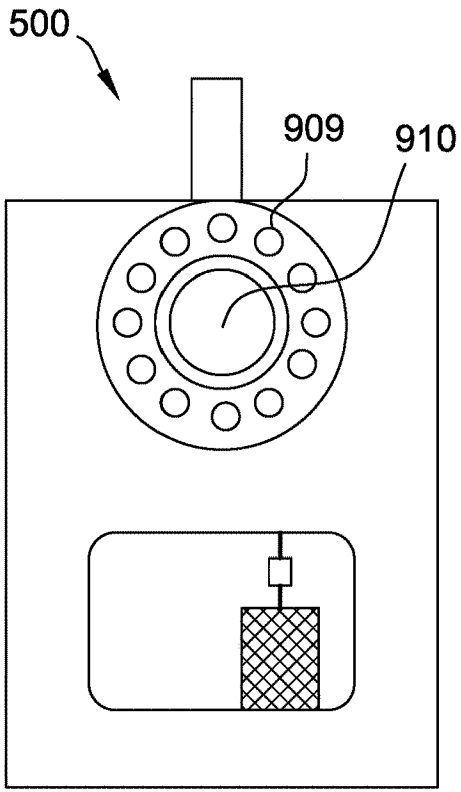

FIG. 10 is a front schematic view of the exemplary logic cap plate assembly shown in FIG. 7.

Figure 11:
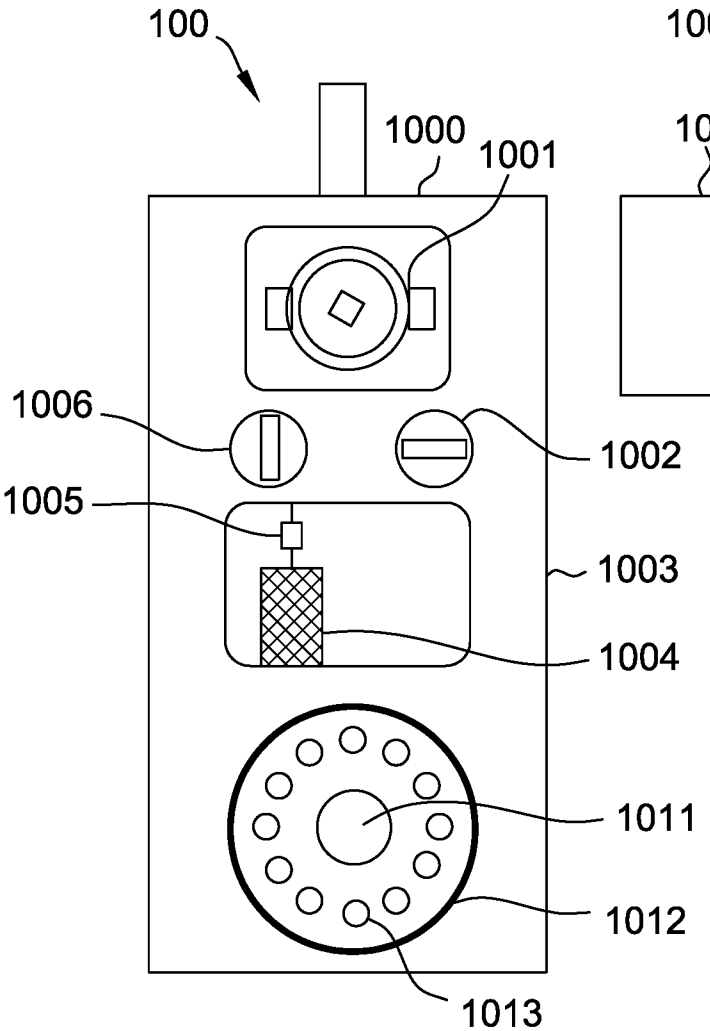

FIG. 11 is a back schematic view of the exemplary retrievable and retrofittable subsea hydraulic dump valve assembly shown in FIGS. 4-6.

Figure 12:
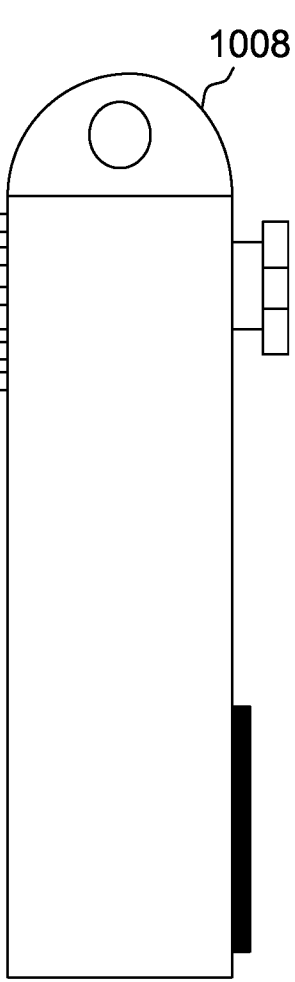

FIG. 12 is a side schematic view of the exemplary retrievable and retrofittable subsea hydraulic dump valve assembly shown in FIGS. 4-6.

Figure 13:
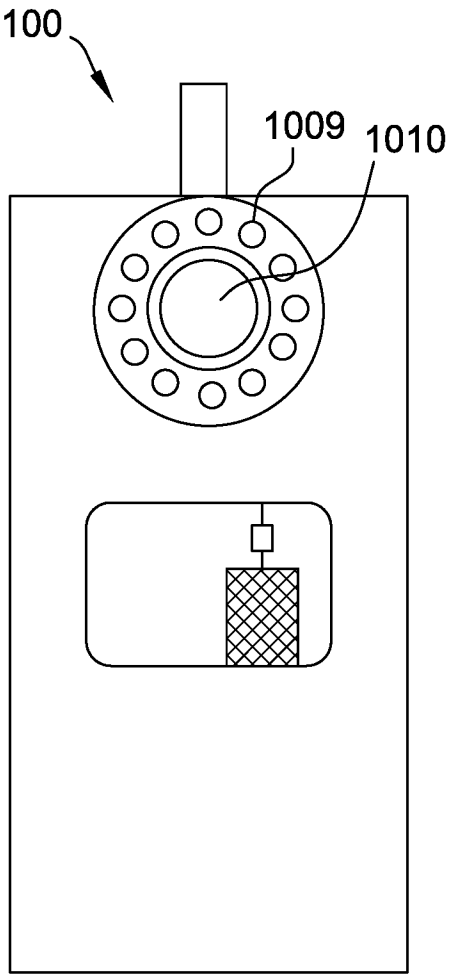

FIG. 13 is a front schematic view of the exemplary retrievable and retrofittable subsea hydraulic dump valve assembly shown in FIGS. 4-6.

Figure 14:
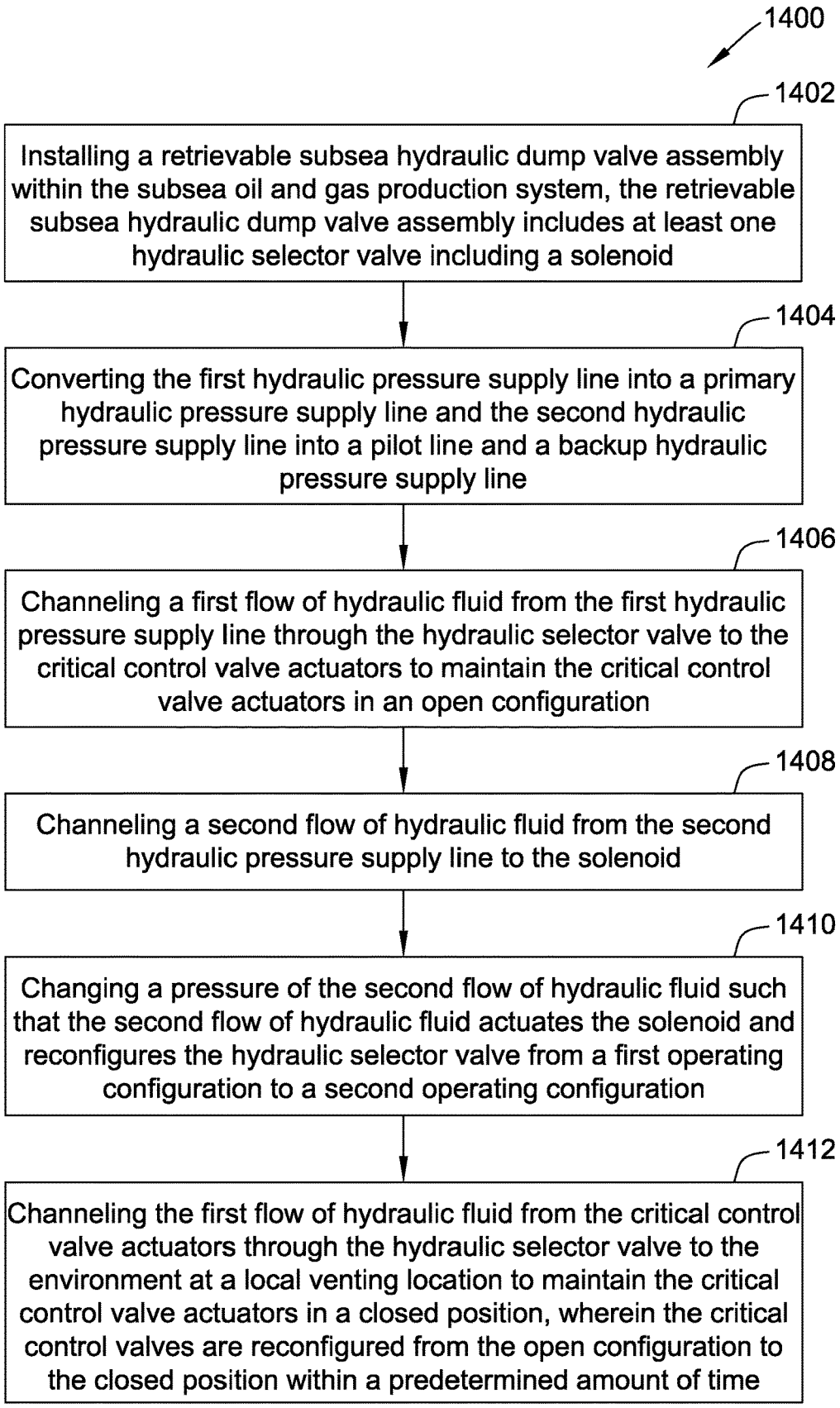

FIG. 14 is a flow diagram of an exemplary method of controlling a source of a hydraulic supply to a plurality of critical control valve actuators within a subsea oil and gas production system.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the terms processor, processing device, and controller.

In the embodiments described herein, memory may include, but is not limited to, a computer-readable medium, such as a random access memory (RAM), and a computer-readable non-volatile medium, such as flash memory. Alternatively, a floppy disk, a compact disc—read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Embodiments of the present disclosure relate to a retrievable and retrofittable subsea hydraulic dump valve assembly which may take the form of an intermediate sandwich plate or external logic cap for quickly exhausting hydraulic fluid using a pilot line from the surface facility as a control transmission line in a subsea oil and gas production system. Currently, most jurisdictions have enacted regulations that require that subsea wells are to be shut-in, or prevented from producing oil and gas, within a predetermined amount of time regardless of communication status. For example, if a loss of communication between a surface facility and the subsea oil and gas well or field occurs, the subsea wells are to be shut-in within the predetermined amount of time. The retrievable and retrofittable subsea hydraulic dump valve assemblies described herein convert an existing a Low Pressure A Hydraulic Supply (LPA) line into a primary hydraulic line and an existing Low Pressure B Hydraulic Supply (LPB) line into a pilot line and back up hydraulic supply line. Because the LPA line pressurizes critical control valve actuators at the subsea oil and gas well, the LPA line has a large volume of hydraulic fluid which would need to flow back towards the surface facility to close. Friction losses within the umbilical line prevent quick closure of the valves at the subsea oil and gas well. However, because the LPB line does not pressurize the critical control valve actuators, the volume of fluid needed to flow back to the surface facility is greatly reduced which allows for the pressure to drop at a faster rate than the LPA line. Thus, the LPB line quickly transmits the depressurization from the surface facility, and the retrievable quick dump valve quickly depressurizes the critical control valves such that the critical control valves are closed within the predetermined amount of time. Additionally, because the retrievable quick dump valve assembly will be packaged into a sandwich plate or logic cap that matches the existing multi quick coupler MQC plates, the quick dump valve assembly can be installed or retrofitted into the subsea oil and gas production system at various locations within the subsea oil and gas production system with minimal disruption. Moreover, because the retrievable and retrofittable subsea hydraulic dump valve assembly uses redundant hydraulic lines, the LPA line and the LPB line, to channel hydraulic fluid and transmit pressure changes at the surface facility, the sandwich plate can be quickly installed with low capital costs and minimal disruption to the subsea oil and gas production system. Furthermore, subsea production system safety systems are typically programed to vent both LPA and LPB lines when a loss of communication event occurs. The retrievable and retrofittable subsea hydraulic dump valve assemblies described herein quickly shut in the subsea wells without additions or modifications to topside control systems.

FIG. 1 is a schematic illustration of an exemplary subsea oil and gas production system 10. The production system 10 includes a surface facility 12 connected via at least one umbilical 14 to at least one subsea production system 16, including a plurality of wells, on the seabed. In the illustrated embodiment, the surface facility 12 is a floating production facility. In alternative embodiments, the surface facility 12 may be substituted for any other suitable vessel at the water surface or land based facility. In the illustrated embodiment, the production system 10 includes a single surface facility 12, a single umbilical 14, and a single subsea production system 16. In alternative embodiments, the production system 10 may include any number of surface facilities 12, umbilicals 14, and subsea production systems 16 that enable the production system 10 to operate as described herein, including a plurality of surface facilities 12, a plurality of umbilicals 14, and a plurality of subsea production systems 16. The subsea production system 16 receives hydraulics, electrical power, communications, fiber optics, chemicals, and/or any other utility that enables the subsea production system 16 to operate as described herein from the umbilical 14. Specifically, the umbilical 14 is typically a single conduit that includes a plurality of pipes, tubes, cables, fiber optics, and/or any other conduit used to transport utilities and communications within the conduit. The umbilical 14 includes a first end 18 attached to the surface facility 12 and an Umbilical Termination Head (UTH) 20 attached to the subsea production system 16. The umbilical 14 is typically more than a kilometer long, and, as such, a pressure of fluids channeled through the umbilical 14 is subjected friction losses. Additionally, a change in pressure may take several minutes to be communicated to the subsea production system 16 because of the friction losses and volume of valve actuators.

The production system 10 produces oil and gas by extracting oil and gas at the seabed and transporting the produced oil and gas to a processing facility. The processing facility may be the surface facility 12, another surface facility, and/or an on-shore processing facility. The utilities channeled by the umbilical 14 to the subsea production system 16 from the surface facility 12 are used to control the subsea production system 16 and the production of oil and gas from the wells of the subsea production system 16. Specifically, hydraulic fluid channeled by the umbilical 14 to the subsea production system 16 from the surface facility 12 is used to control valves within the subsea production system 16. More specifically, hydraulic fluid channeled by the umbilical 14 to the subsea production system 16 from the surface facility 12 is used to control critical safety valves, such as, but not limited to control gate valves, ball valves, choke valves and shut-off valves, and/or blowout preventers, within the subsea production system 16.

When the surface facility 12 loses communication with the subsea production system 16, critical safety valves remain in their last state which may be open allowing the well to continue to flow without the ability to monitor the well. To close the critical safety valves during a loss of communications event, hydraulics must be vented which can only be triggered from the surface facility. This process may take a long time to occur because of the length of the umbilical and the amount of wells and valves included in the system. Currently, most jurisdictions regulate the production of oil and gas from subsea oil and gas production systems, such as the subsea oil and gas production system 10, and have enacted regulations that require that subsea wells are secured or shut-in, preventing production of oil and gas, within a predetermined amount of time in an emergency situation. Loss of communication between the surface facility 12 and the subsea production system 16 can prevent the operator's ability to secure the well within the predetermined amount of time. This results in the operator seeking exceptions from regulatory agencies and usually results in the proactive shut in of wells hydraulically upon loss of communications with the subsea system or well. Ideally, if loss of communication occurred, it is preferable to allow the wells to continue to produce while troubleshooting the communication loss. A retrievable hydraulic dump valve assembly 100 allows for the larger hydraulic inventory stored in the tree valve actuators to be exhausted locally, not at the surface facility through the umbilical 14, which is subject to friction loss.

Specifically, subsea oil and gas production system 10 also includes a first hydraulic pressure supply line, a second hydraulic pressure supply line, a plurality of critical control valve actuators, and a SCM hydraulic selector valve. The first hydraulic pressure supply line and the second hydraulic pressure supply line each channel a flow of hydraulic fluid to the SCM hydraulic selector valve. The SCM hydraulic selector valve selects one of the first hydraulic pressure supply line and the second hydraulic pressure supply line to channel the flow of hydraulic fluid to the critical control valve actuators to maintain the critical control valve actuators in an open configuration. The unselected hydraulic pressure supply line is a backup hydraulic pressure supply line for the critical control valve actuators. During a loss of communication event, the critical control valve actuators are reconfigured into a closed configuration within a first reconfiguration time by simultaneously depressurizing the first hydraulic pressure supply line and the second hydraulic pressure supply line. Depressurization allows the critical control valve actuators to close. However, friction loss in the first hydraulic pressure supply line and the second hydraulic pressure supply line may cause the first reconfiguration time to be longer than the predetermined amount of time required by regulators.

The subsea production system 16 includes at least one umbilical termination head 22, may include one or more hydraulic distribution manifold (HDM) 24, and at least one subsea tree 26. While the subsea production system 16 is illustrated as including a single umbilical termination head 22, HDM 24, and subsea tree 26, the subsea production system 16 may include a plurality of umbilical termination heads 22, a plurality of HDMs 24, and a plurality of subsea trees 26. The umbilical 14 is attached to the umbilical termination head 22 which separates the pipes, tubes, cables, fiber optics, and/or other conduits within the umbilical 14 for distribution to the rest of the subsea production system 16. The HDM 24 is coupled to the umbilical termination head 22 by at least one umbilical steel flying lead (SFL) or umbilical termination jumper 28 and receives utilities, including hydraulic fluid, from the umbilical termination head 22 via the umbilical SFL 28. The HDM 24 is coupled to the subsea trees 26 by at least one production tree SFL 30. The HDM 24 distributes the utilities from the umbilical termination head 22 to the subsea trees 26.

The umbilical termination head 22, the HDM 24, the subsea tree 26, the umbilical SFL 28, and the production tree SFL 30 each typically include at least one Multi Quick Connect (MQC) plate. More specifically, the umbilical SFL 28 and the production tree SFL 30 each typically include a MQC plate attached to each end of the umbilical SFL 28 and the production tree SFL 30, and the umbilical termination head 22, the HDM 24, and the subsea trees 26 each typically include at least one inbound MQC plate and at least one outbound MQC plate. MQC plates enable the umbilical SFL 28 and the production tree SFL 30 to be quickly connected to the umbilical termination head 22, the HDM 24, and the subsea tree 26. For example, an MQC plate on an end of the production tree SFL 30 has connections that correspond to the connection of an inbound MQC plate of the subsea tree 26. Each connection transports a utility, such as hydraulic fluid, from the production tree SFL 30 to the subsea tree 26. Because the connections between the two MQC plates correspond to each other, disconnecting the two MQC plates disconnects all utilities between the production tree SFL 30 and the subsea tree 26. Accordingly, MQC plates enable the quick connection and disconnection of components within the subsea production system 16.

More specifically, the umbilical termination head 22, the HDM 24, the umbilical SFL 28, and the production tree SFL 30 all include outbound MQC plates 32, and the HDM 24, the subsea tree 26, the umbilical SFL 28, and the production tree SFL 30 all include inbound MQC plates 34. Mating outbound MQC plates 32 and inbound MQC plates 34 have corresponding connections. However, outbound MQC plates 32 and inbound MQC plates 34 may have different configurations depending on the components they are connecting. Additionally, the umbilical termination head 22, the HDM 24, and the subsea tree 26 may also include at least one outboard hydraulic logic cap 36 that controls the routing of chemicals and hydraulic fluids within the subsea production system 16.

The subsea trees 26 each typically include a plurality of critical safety valves, such as, but not limited to control gate valves, ratcheting chokes, and/or shut-off valves, that shut-in the subsea trees 26 when the surface facility 12 directs the subsea trees 26 to be shut-in. The critical safety valves are controlled and held open by hydraulic fluids from the surface facility 12. In order to quickly close the critical safety valves through hydraulic venting from the surface, the subsea production system 16 includes at least one retrievable hydraulic dump valve in the form of the retrievable and retrofittable subsea hydraulic dump valve assembly 100 that controls the permits the transmission of hydraulic fluid or exhausts it allowing the closure of critical safety valves. In the illustrated embodiment, the retrievable hydraulic dump valve assembly 100 is positioned between the outbound MQC plate 32 of the production tree SFL 30 and the inbound MQC plate 34 of the subsea tree 26.

FIGS. 2 and 3 illustrate alternative locations for the retrievable and retrofittable subsea hydraulic dump valve assembly 100. Specifically, FIG. 2 is a block diagram of the exemplary subsea oil and gas production system 10 including the retrievable subsea hydraulic dump valve in the form of a logic plate assembly 500 attached to the inboard hydraulic logic cap plate of the HDM 24. The schematic configuration of the logic plate assembly 500 is shown in FIG. 7 and would exhaust the entire hydraulic circuit locally on demand. FIG. 3 is a block diagram of the exemplary subsea oil and gas production system 10 including the retrievable subsea hydraulic dump valve in the form of the retrievable and retrofittable subsea hydraulic dump valve assembly 100 positioned between the outbound MQC plate 32 of the umbilical termination head 22 and the inbound MQC plate 34 of the umbilical SFL 28. In alternative embodiments, the retrievable and retrofittable subsea hydraulic dump valve assembly 100 may be positioned at any locations within the subsea production system 16 that enables subsea production system 16 to operate as described herein.

FIG. 4 is a schematic illustration of an exemplary retrievable and retrofittable subsea hydraulic dump valve assembly 100 in a first operating configuration. In the illustrated embodiment, the retrievable and retrofittable subsea hydraulic dump valve assembly 100 is positioned between an SCM partially illustrated as 200 for simplicity in FIG. 4 and a production tree SFL partially illustrated as 300 in FIG. 4 as shown in FIG. 1. The production tree SFL 300 includes two low pressure hydraulic supply lines 301 and 302. Specifically, the production tree SFL 300 includes a Low Pressure A Hydraulic Supply (LPA) 301, a Low Pressure B Hydraulic Supply (LPB) 302, an outboard production tree SFL MQC plate 303, and a plurality of additional utility conduits 304. The production tree SFL 300 channels hydraulic fluid and other utilities from the HDM 24 or UTH to the retrievable and retrofittable subsea hydraulic dump valve assembly 100 through the LPA 301, the LPB 302, and the additional utility conduits 304. The LPA 301 and the LPB 302 are redundant low-pressure hydraulic fluid supply lines that channel hydraulic fluid from the surface facility to the critical control valve actuators. The subsea SCM 200 selects one of the LPA 301 and the LPB 302 to provide hydraulic pressure to the critical control valve actuators. For example, in the event that the LPA 301 has a leak, the subsea SCM 200 selects the LPB 302 to provide hydraulic pressure to the critical control valve actuators.

The subsea SCM 200 includes two low pressure hydraulic supply lines 201 and 207 which are equal redundant supplies which can be used to open critical control valves with subsea trees 26. A SCM hydraulic selector valve 210 selects one of the two low pressure hydraulic supply lines 201 and 207 to supply hydraulic pressure while blocking the other supply line. The selected supply line can be selected by the surface facility control system when communications are available. Once a supply is selected, it will not be changed until the surface facility control system directs the SCM hydraulic selector valve 210 to select the unselected supply line because it will be hydraulically latched by the selected supply line. Specifically, the subsea SCM 200 depicted in FIGS. 4-6 includes a SCM primary hydraulic supply (PHS) 201, a first hydraulic pilot path 202, a first electrical solenoid 203, a SCM hydraulic header 204, a second electrical solenoid 205, a second hydraulic pilot path 206, a SCM secondary hydraulic supply (SHS) 207, a plurality of additional utility conduits 208, an inboard subsea tree MQC plate 209, and a SCM hydraulic selector 210. The subsea SCM 200 channels hydraulic fluid and other utilities from the retrievable and retrofittable subsea hydraulic dump valve assembly 100 to the subsea tree 26 through the SCM PHS 201, the SCM SHS 207, and the additional utility conduits 208. When activated, the first hydraulic pilot path 202 and the first electrical solenoid 203 configure the SCM hydraulic selector 210 to channel the hydraulic fluid from the SCM PHS 201 to the SCM hydraulic header 204. Similarly, when activated, the second hydraulic pilot path 206 and the second electrical solenoid 205 configure the SCM hydraulic selector 210 to channel the hydraulic fluid from the SCM SHS 207 to the SCM hydraulic header 204. More specifically, the surface facility 12 sends an electrical signal to one of the first electrical solenoid 203 and the second electrical solenoid 205. The first electrical solenoid 203 and the second electrical solenoid 205 then reconfigure the SCM hydraulic selector 210 to select the selected supply line for the SCM hydraulic header 204. Accordingly, the SCM hydraulic selector 210 enabled the SCM PHS 201 and the SCM SHS 207 to be redundant hydraulic fluid supply lines and enabled the surface facility 12 to select which supply line provides hydraulic fluid to the critical control valve actuators.

The retrievable and retrofittable subsea hydraulic dump valve assembly 100 includes an inboard MQC plate 101, a primary hydraulic supply (PHS) 102, a first three-way valve 103, a dump valve bypass line 104, a second three-way valve 105, a primary hydraulic header 106, an outboard MQC plate 107, a secondary hydraulic supply (SHS) 108, a hydraulic selector valve 109 with preset spring for reset, a check valve 110 with a specified cracking pressure, a marine growth preventer 111, and a plurality of additional utility conduits 112 which may make cross connections to function as a logic cap.

The inboard MQC plate 101 has a plurality of couplers 120, and the outboard production tree SFL MQC plate 303 includes a plurality of couplers 320 that correspond to the couplers 120. As such, when the inboard MQC plate 101 mates with the outboard production tree SFL MQC plate 303, the PHS 102, the SHS 108, and the additional utility conduits 112 mate with the LPA 301, the LPB 302, and the additional utility conduits 304. Similarly, the outboard MQC plate 107 has a plurality of couplers 122, and the inboard subsea tree MQC plate 209 includes a plurality of couplers 222 that correspond to the couplers 122. As such, when the outboard MQC plate 107 mates with the inboard subsea tree MQC plate 209, the primary hydraulic header 106, the SHS 108, and the additional utility conduits 112 mate with the SCM PHS 201, the SCM SHS 207, and the additional utility conduits 208.

In the illustrated embodiment, the first three-way valve 103 and the second three-way valve 105 are three-way valves that receive a fluid (i.e., hydraulic fluid) and channel the fluid to one of two destinations. Specifically, the first three-way valve 103 is coupled to the PHS 102, the dump valve bypass line 104, and the hydraulic selector valve 109. As will be described in greater detail below, the first three-way valve 103 channels hydraulic fluid from the PHS line 102 to either the hydraulic selector valve 109 or the dump valve bypass line 104. Similarly, the second three-way valve 105 is coupled to the primary hydraulic header 106, the dump valve bypass line 104, and the hydraulic selector valve 109. As will be described in greater detail below, the second three-way valve 105 channels hydraulic fluid from either the dump valve bypass line 104 or the hydraulic selector valve 109 to the primary hydraulic header 106. The SHS 108 is also used as a pilot or control line for the hydraulic selector valve 109. The pilot pressure acts against a reset spring on the hydraulic selector valve 109 that is set specifically for the application so that the hydraulic selector valve 109 will vent the PHS 102 at a specified pilot pressure. The reset pressure may be selected to minimize the vent time while minimizing unintended closures of the valves. This will be field specific and take into account water depth and required vent times. More specifically, the reset spring exerts an engineered force against the pilot pressure that resists reconfiguration by changes in the pilot pressure. As such, the reset spring allows changes in the pilot pressure to reconfigure the hydraulic selector valve 109 only when the pilot pressure changes enough to overcome resistance from the reset spring, minimizing unintended closures of the valves.

The force of the reset spring is tuned for the specific operating parameters of the production system 10 (such as operating pressure, depth, the umbilical 14 length, etc.)

In the illustrated embodiment, the hydraulic selector valve 109 and the SCM hydraulic selector 210 are both hydraulic selector valves or shuttle valves capable of selecting a flow of hydraulic fluid to be channeled by the valve to a target destination based on a hydraulic input from another source of hydraulic fluid. Specifically, the hydraulic selector valve 109 includes a first inlet 130, a first outlet 132, a second inlet 134, a second outlet 136, a third inlet 138, a first cap 140, and a second cap 142. As will be described below, the first three-way valve 103 may be coupled to the first inlet 130 and the first cap 140, and the second three-way valve 105 may be coupled to the first outlet 132 and the second inlet 134 depending on the operating mode of the system. Additionally, the check valve 110 and the marine growth preventer 111 are coupled to the second cap 142 and the second outlet 136 depending on the operating mode of the system. The check valve 110 is a spring-loaded check valve that requires a predetermined pressure to open. Specifically, in this embodiment, the predetermined pressure is above ambient pressure such that sea water is prevented from entering the hydraulic system. Finally, the SHS 108 is coupled to the third inlet 138 and selects the operating mode of the hydraulic selector valve 109. In FIGS. 4-6 the hydraulic selector valve 109 and the SCM hydraulic selector 210 are illustrated as externally changing the connections of the hydraulic selector valve 109 and the SCM hydraulic selector 210. For example, in FIGS. 4-6 the connections between the hydraulic selector valve 109, the first three-way valve 103, the second three-way valve 105, and the check valve 110 are illustrated as changing externally of the hydraulic selector valve 109. However, this is for illustrative purposes only and the connections between the hydraulic selector valve 109, the first three-way valve 103, the second three-way valve 105, and the check valve 110 are changed internally of the hydraulic selector valve 109 by reconfiguring the hydraulic selector valve 109.

FIG. 4 illustrates the retrievable and retrofittable subsea hydraulic dump valve assembly 100 in a first operating configuration. Hydraulic lines that are illustrated as solid lines in FIGS. 4-6 are pressurized lines, and hydraulic lines that are illustrated as dashed lines in FIGS. 4-6 are depressurized lines. During operation of the retrievable and retrofittable subsea hydraulic dump valve assembly 100 in the first operating configuration illustrated in FIG. 4, the LPA 301 and the LPB 302 are pressurized by the surface facility 12 and channel the pressurized hydraulic fluid to the PHS 102 and the SHS 108. The SHS 108 channels the hydraulic fluid to the third inlet 138. The pressurized hydraulic fluid within the third inlet 138 engages the electrical solenoid 113 which electrically configures the hydraulic selector valve 109 in the first operating configuration. More specifically, the first operating configuration is configured to enable the subsea SCM 200 to operate normally (i.e., producing oil and gas) by maintaining the critical control valves in an open configuration.

In the first operating configuration the first three-way valve 103 is coupled to the first inlet 130, and the second three-way valve 105 is coupled to the first outlet 132. Additionally, the first three-way valve 103 channels hydraulic fluid from the PHS 102 to the first inlet 130, and the second three-way valve 105 channels hydraulic fluid from the first outlet 132 to the primary hydraulic header 106. Accordingly, in the first operating configuration, the hydraulic selector valve 109 channels pressurized hydraulic fluid from the surface facility 12 to the critical control valves such that the hydraulic fluid maintains the critical control valves in an open configuration to maintain production of oil and gas from the subsea SCM 200.

However, if the surface facility 12 loses communication with the subsea SCM 200, the critical control valves are required to be closed within the predetermined amount of time determined by a regulatory agency. FIG. 5 is a schematic illustration of the retrievable and retrofittable subsea hydraulic dump valve assembly 100 in a second operating configuration that enables the critical control valves to be closed within a second reconfiguration time that is less than the first reconfiguration time and may be less than the predetermined amount of time. As used herein, the terms "quick" and "quickly," when used in the context of (1) closing the critical control valves, (2) venting hydraulic fluid from the critical control valves and/or hydraulic supply lines, or (3) reconfiguring the critical control valves between an open configuration and a closed configuration, mean that the critical control valves are closed or opened within a time that is less than the first reconfiguration time defined above. During operation of the retrievable and retrofittable subsea hydraulic dump valve assembly 100 in the second operating configuration illustrated in FIG. 5, the LPA 301 is depressurized by the surface facility 12 and begins to vent fluid back to the surface facility through PHS 102, but this will take a long time. The LPB 302 is also simultaneously depressurized by the surface facility 12 and vents hydraulic fluid to the SHS 108. The SHS 108 loses hydraulic pressure to the third inlet 138, and the depressurized hydraulic fluid within the third inlet 138 disengages the hydraulic solenoid 113 which causes the spring in the hydraulic selector valve 109 to shift into the second operating configuration allowing the PHS line 108 to drop towards ambient pressure. More specifically, the second operating configuration is configured to enable the subsea SCM 200 to quickly cease normal operations (i.e., stop producing oil and gas) by quickly closing the critical control valves.

In the second operating configuration, the hydraulic selector valve 109 is reconfigured such that the first three-way valve 103 is coupled to the first cap 140, and the second three-way valve 105 is coupled to the second inlet 134. As such, the first three-way valve 103 is prevented from channeling hydraulic fluid from the PHS 102 through the first inlet 130 to the second three-way valve 105 and the primary hydraulic header 106. Rather, the second three-way valve 105 channels hydraulic fluid from the primary hydraulic header 106 through the hydraulic selector valve 109 to the check valve 110, the marine growth preventer 111, and into the environment. That is, when reconfigured in the second operating configuration, the hydraulic selector valve 109 prevents hydraulic fluid from flowing from the surface facility 12 to the primary hydraulic header 106 and vents the hydraulic fluid that is within the primary hydraulic header 106 and the control valve actuators into the sea. Thus, the primary hydraulic header 106, the SCM PHS 201, and the SCM hydraulic header 204 are depressurized, and the critical control valves are also depressurized and closed. Accordingly, in the second operating configuration, the hydraulic selector valve 109 does not channel pressurized hydraulic fluid from the surface facility 12 to the critical control valves, and the critical control valves close to cease production of oil and gas from the subsea SCM 200.

Because the LPA 301 pressurizes the critical control valves, the LPA 301 has a large volume of hydraulic fluid and friction losses within the umbilical 14 prevent quick pressure changes at the surface facility 12 from being quickly transmitted to the subsea SCM 200. However, because the LPB 302 does not pressurize the critical control valves, the friction losses within the umbilical 14 have reduced impact on the delay of pressure changes at the surface facility 12 being transmitted to the hydraulic selector valve 109 and subsea SCM 200. Thus, the LPB 302 quickly transmits the depressurization from the surface facility 12, and the hydraulic selector valve 109 quickly depressurizes the primary hydraulic header 106, the SCM PHS 201, and the SCM hydraulic header 204 to the subsea environment at a local venting location to reconfigure the critical control valve actuators into a closed configuration within the second reconfiguration time that is less than the first reconfiguration time and may be less than within the predetermined amount of time. Additionally, because the retrievable and retrofittable subsea hydraulic dump valve assembly 100 includes MQC plates 101 and 107, the retrievable and retrofittable subsea hydraulic dump valve assembly 100 can be quickly installed in the subsea oil and gas production system 10 at various locations within the subsea oil and gas production system 10 with minimal disruption to the subsea oil and gas production system 10. Moreover, because the retrievable and retrofittable subsea hydraulic dump valve assembly 100 uses the existing redundant hydraulic lines, the LPA 301 and the LPB 302, to channel hydraulic fluid and transmit pressure changes at the surface facility, the retrievable and retrofittable subsea hydraulic dump valve assembly 100 can be quickly installed with low capital costs and minimal disruption to the subsea oil and gas production system 10. Furthermore, because the retrievable and retrofittable subsea hydraulic dump valve assembly 100 can be quickly installed in the subsea oil and gas production system 10 at various locations, it is also retrievable and/or repositionable within the subsea oil and gas production system 10 or other subsea oil and gas production systems.

As described above, the LPB 302 is converted from a fully redundant hydraulic fluid supply line into a pilot line configured to quickly transmit pressure changes at the surface facility 12 to the retrievable and retrofittable subsea hydraulic dump valve assembly 100. However, the LPB 302 also remains a redundant hydraulic fluid supply line as well. If the LPA 301 becomes inoperable (i.e., has a leak), the LPB 302 can still supply hydraulic fluid to the critical control valve actuators without disrupting operations of the subsea oil and gas production system 10. For example, if the LPA 301 develops a leak, the retrievable and retrofittable subsea hydraulic dump valve assembly 100 is configured in the first operating configuration and the SCM hydraulic selector 210 is configured to channel the hydraulic fluid from the SCM SHS 207 to the SCM hydraulic header 204 and to prevent the SCM PHS 201 from channeling hydraulic fluid to the SCM hydraulic header 204. However, when the LPB 302 is supplying hydraulic fluid to the critical control valve actuators, the quick close capability of the retrievable and retrofittable subsea hydraulic dump valve assembly 100 is lost because the LPB 302 is no longer a pilot line. As such, the LPB 302 also remains a redundant hydraulic fluid supply line as well as a pilot line. Accordingly, the retrievable and retrofittable subsea hydraulic dump valve assembly 100 described herein converts the LPA 301 into a hydraulic fluid supply line and the LPB 302 into a hydraulic fluid pilot line and a fully redundant hydraulic fluid supply line.

FIG. 6 is a schematic illustration of the retrievable and retrofittable subsea hydraulic dump valve assembly 100 in a third operating configuration that enables the hydraulic fluid in the LPA 301 to bypass the hydraulic selector valve 109. More specifically, in the third operating configuration the first three-way valve 103 is coupled to the dump valve bypass line 104, and the second three-way valve 105 is also coupled to the dump valve bypass line 104. Additionally, the first three-way valve 103 channels hydraulic fluid from the PHS 102 to the dump valve bypass line 104, and the second three-way valve 105 channels hydraulic fluid from the dump valve bypass line 104 to the primary hydraulic header 106. Accordingly, in the third configuration, the hydraulic selector valve 109 channels pressurized hydraulic fluid from the surface facility 12 to the critical control valves such that the hydraulic fluid maintains the critical control valves in an open configuration to maintain production of oil and gas from the subsea SCM 200. That is, in the third configuration, the hydraulic selector valve 109 is bypassed such that the system operates as though the retrievable and retrofittable subsea hydraulic dump valve assembly 100 is not installed.

FIG. 7 is a schematic illustration of another embodiment of a retrievable and retrofittable subsea hydraulic dump valve assembly in the form of a logic cap assembly 500 coupled to the inboard MQC plate 36. In the illustrated embodiment, the logic cap plate assembly 500 is positioned on the inboard MQC plate 36 of the HDM 24 shown in FIG. 2 and partially illustrated as 501 for simplicity in FIG. 7. The HDM 501 includes two low pressure hydraulic supply lines 504 and 505. Specifically, the HDM 501 includes a Low Pressure A Hydraulic Supply (LPA) 504, a Low Pressure B Hydraulic Supply (LPB) 505, an inboard HDM MQC plate 502, and a plurality of additional utility conduits 515. The HDM 501 channels hydraulic fluid and other utilities from the HDM 24 to the logic cap plate assembly 500 through the LPA 504, the LPB 505, and the additional utility conduits 515. The LPA 504 and the LPB 505 are redundant low-pressure hydraulic fluid supply lines that channel hydraulic fluid from the surface facility 12 to the critical control valve actuators.

The logic cap plate assembly 500 includes an outboard MQC plate 503, a first isolation valve 506, a LPB hydraulic pilot line 507, a second isolation valve 508, a LPA hydraulic pilot line 509, a first hydraulic selector valve 511 with a preset spring set for predetermined operating conditions, a second hydraulic selector valve 510 with a preset spring set for predetermined operating conditions, a first check valve 512 with a specified cracking pressure, a second check valve 513 with a specified cracking pressure, a third isolation valve 514, and a marine growth preventer 516. The inboard HDM MQC plate 502 mates with the outboard MQC plate 503 in a manner substantially similar to the mating of the inboard MQC plate 101 and the outboard production tree SFL MQC plate 303 described above. The additional utility conduits 515 may be looped back (as shown in FIG. 7) or block to enable the logic cap plate assembly 500 to function as a logic cap. Additionally, the logic cap plate assembly 500 may be configured to perform additional operations on the additional utility conduits 515 if necessary. The first check valve 512 and the second check valve 513 are spring loaded check valve that require a predetermined pressure to open. Specifically, in this embodiment, the predetermined pressure is above ambient pressure such that sea water is prevented from entering the hydraulic system.

In the illustrated embodiment, the first isolation valve 506 and the second isolation valve 508 may be ball or needle valves that isolate the first hydraulic selector valve 511 and the second hydraulic selector valve 510. Specifically, the first isolation valve 506 is coupled to the LPA 504 and the first hydraulic selector valve 511. Additionally, the LPA hydraulic pilot line 509 is coupled to the LPA 504 and an electrical solenoid of the second hydraulic selector valve 510 such that the LPA 504 may be a hydraulic fluid pilot line. Similarly, the second isolation valve 508 is coupled to the LPB 505 and the second hydraulic selector valve 510. Additionally, the LPB hydraulic pilot line 507 is coupled to the LPB 505 and an electrical solenoid of the first hydraulic selector valve 511 such that the LPB 505 may be a hydraulic fluid pilot line. Accordingly, either the LPA 504 or the LPB 505 may be used as a pilot or control line for either of the first hydraulic selector valve 511 or the second hydraulic selector valve 510. The pilot pressure acts against a reset spring as described above minimize the vent time while minimizing unintended closures of the valves. The first hydraulic selector valve 511 is coupled to the first check valve 512, and the second hydraulic selector valve 510 is coupled to the second check valve 513. The first check valve 512 and the second check valve 513 are both coupled to the third isolation valve 514 and the marine growth preventer 516. The third isolation valve 514 allows or prevents the first hydraulic selector valve 511 or the second hydraulic selector valve 510 venting hydraulic fluid into the environment.

During operations of the logic cap plate assembly 500, the surface facility 12 selects either the LPA 504 or the LPB 505 to be the hydraulic fluid supply line and the other line to be the pilot line. For example, when the LPA 504 is primary supply line, the LPB 505 is the pilot line, the first isolation valve 506 is open, the second isolation valve 508 is closed, and the third isolation valve 514 is open. The LPA 504 channels hydraulic fluid to the first hydraulic selector valve 511, but the first hydraulic selector valve 511 prevents the hydraulic fluid from flowing to the first check valve 512, the third isolation valve 514, and to the environment. The LPB 505 channels hydraulic fluid to the electrical solenoid of the first hydraulic selector valve 511 through the LPB hydraulic pilot line 507, and the second isolation valve 508 prevents hydraulic fluid from flowing to the second hydraulic selector valve 510. When a loss of communication event occurs, both the LPA 504 and the LPB 505 are vented at the surface facility 12. When the pressure of the LPB 505 is reduced below a predetermined pressure, the first hydraulic selector valve 511 reconfigures to allow the hydraulic fluid within the LPA 504 to be vented to the environment through the first check valve 512, the third isolation valve 514, and the marine growth preventer 516. As described above, the LPB 505 can quickly transmit pressure changes to the logic cap plate assembly 500, and the hydraulic fluid in the LPA 504 is vented locally such that the critical control valves quickly close.

Alternatively, when the LPB 505 is primary supply line, the LPA 504 is the pilot line, the first isolation valve 506 is closed, the second isolation valve 508 is open, and the third isolation valve 514 is open. The LPB 505 channels hydraulic fluid to the second hydraulic selector valve 510, but the second hydraulic selector valve 510 prevents the hydraulic fluid from flowing to the second check valve 513, the third isolation valve 514, and to the environment. The LPA 504 channels hydraulic fluid to the electrical solenoid of the second hydraulic selector valve 510 through the LPA hydraulic pilot line 509, and the first isolation valve 506 prevents hydraulic fluid from flowing to the first hydraulic selector valve 511. When a loss of communication event occurs, both the LPA 504 and the LPB 505 are vented at the surface facility 12. When the pressure of the LPA 504 is reduced below a predetermined pressure, the second hydraulic selector valve 510 reconfigures to allow the hydraulic fluid within the LPB 505 to be vented to the environment through the second check valve 513, the third isolation valve 514, and the marine growth preventer 516. As described above, the LPA 504 can quickly transmit pressure changes to the logic cap plate assembly 500, and the hydraulic fluid in the LPB 505 is vented locally such that the critical control valves quickly close. Additionally, the logic cap plate assembly 500 is reconfigurable between using the LPA 504 or the LPB 505 as the primary hydraulic fluid supply line by opening and closing the first isolation valve 506 and the second isolation valve 508. Furthermore, the logic cap plate assembly 500 may be deactivated by closing both the first isolation valve 506 and the second isolation valve 508 or closing only the third isolation valve 514.

The logic cap plate assembly 500 is positioned in parallel with the critical control valve actuators rather than the in-series arrangement of the retrievable and retrofittable subsea hydraulic dump valve assembly 100 shown in FIGS. 4-6. That is, the retrievable and retrofittable subsea hydraulic dump valve assembly 100 shown in FIGS. 4-6 allowed or prevented hydraulic fluid from flowing to the critical control valve actuators. In contrast, the logic cap plate assembly 500 shown in FIG. 7 vents hydraulic fluid without preventing hydraulic fluid from flowing to the critical control valve actuators.

FIG. 8 is a back schematic view of the logic cap plate assembly 500. FIG. 9 is a side schematic view of the logic cap plate assembly 500. FIG. 10 is a front schematic view of the logic cap plate assembly 500. The logic cap plate assembly 500 includes a bucket interface 901, a first ROV valve assembly 902, a protective shroud 903, a marine growth preventing 904, a check valve 905, a second ROV valve assembly 906, an outboard MQC junction plate 907, a lifting eye 908, a plurality of female coupler 909, a MQC mating mechanism 910, and a third ROV valve assembly 911. The protective shroud 903 surrounds and protects the other components. The bucket interface 901 mates to adjacent junction plates. The first ROV valve assembly 902 controls the first isolation valve 506, the second ROV valve assembly 906 controls the second isolation valve 508, and the third ROV valve assembly 911 controls the third isolation valve 514. The lifting eye 908 enables the logic cap plate assembly 500 to be install at the sea floor. The outboard MQC junction plate 907 enables the logic cap plate assembly 500 to mate to other MQCs. The marine growth preventing 904 prevents marine growth on the check valve 905, and the check valve 905 prevents sea water from flowing into the logic cap plate assembly 500. The MQC mating mechanism 910 enables the female couplers 909 to couple to other couplers.

FIG. 11 is a back schematic view of the retrievable and retrofittable subsea hydraulic dump valve assembly 100. FIG. 12 is a side schematic view of the retrievable and retrofittable subsea hydraulic dump valve assembly 100. FIG. 13 is a front schematic view of the retrievable and retrofittable subsea hydraulic dump valve assembly 100. The retrievable and retrofittable subsea hydraulic dump valve assembly 100 includes a bucket interface 1001, a first ROV valve assembly 1002, a protective shroud 1003, a marine growth preventing 1004, a check valve 1005, a second ROV valve assembly 1006, an outboard MQC junction plate 1007, a lifting eye 1008, a plurality of female coupler 1009, an outboard MQC mating mechanism 1010, an inboard MQC mating mechanism 1011, an inboard MQC junction plate 1012, and a plurality of male couplers 1013. The protective shroud 1003 surrounds and protects the other components. The bucket interface 1001 mates to adjacent junction plates. The first ROV valve assembly 1002 controls the first three-way valve 103, and the second ROV valve assembly 1006 controls the second three-way valve 105. The lifting eye

1008 enables the retrievable and retrofittable subsea hydraulic dump valve assembly 100 to be install at the sea floor. The outboard MQC junction plate 1007 enables the retrievable and retrofittable subsea hydraulic dump valve assembly 100 to mate to other MQCs. The marine growth preventing 1004 prevents marine growth on the check valve 1005, and the check valve 1005 prevents sea water from flowing into the retrievable and retrofittable subsea hydraulic dump valve assembly 100. The outboard MQC mating mechanism 1010 enables the female couplers 1009 to couple to other couplers. The inboard MQC mating mechanism 1011 enables the male couplers 1013 to couple to other couplers. The inboard MQC junction plate 1012 enables the retrievable and retrofittable subsea hydraulic dump valve assembly 100 to mate to other MQCs.

FIG. 14 is a flow diagram of an exemplary method 1400 of controlling a source of a hydraulic supply to a plurality of critical control valve actuators within a subsea oil and gas production system. The method 1400 begins by installing 1402 a retrievable subsea hydraulic dump valve assembly within the subsea oil and gas production system, the retrievable subsea hydraulic dump valve assembly includes at least one hydraulic selector valve including a solenoid. The method 1400 includes converting 1404 the first hydraulic pressure supply line into a primary hydraulic pressure supply line and the second hydraulic pressure supply line into a pilot line and a backup hydraulic pressure supply line. The method 1400 also includes channeling 1406 a first flow of hydraulic fluid from the first hydraulic pressure supply line through the hydraulic selector valve to the critical control valve actuators to maintain the critical control valve actuators in an open configuration. The method 1400 further includes channeling 1408 a second flow of hydraulic fluid from the second hydraulic pressure supply line to the solenoid. The method 1400 also includes changing 1410 a pressure of the second flow of hydraulic fluid such that the second flow of hydraulic fluid actuates the solenoid and reconfigures the hydraulic selector valve from a first operating configuration to a second operating configuration. The method 1400 also includes channeling 1412 the first flow of hydraulic fluid from the critical control valve actuators through the hydraulic selector valve to the environment at a local venting location to maintain the critical control valve actuators in a closed position, wherein the critical control valves are reconfigured from the open configuration to the closed position within a predetermined amount of time.

The above described systems provide a retrievable and retrofittable subsea hydraulic dump valve assembly which may take the form of an intermediate sandwich plate or external logic cap for quickly exhausting hydraulic fluid using a pilot line from the surface facility as a control transmission line in a subsea oil and gas production system. Currently, most jurisdictions have enacted regulations that require that subsea wells are to be shut-in, or prevented from producing oil and gas, within a predetermined amount of time regardless of communication status. For example, if a loss of communication between a surface facility and the subsea oil and gas well or field occurs, the subsea wells are to be shut-in within the predetermined amount of time. The retrievable and retrofittable subsea hydraulic dump valve assemblies described herein convert an existing a Low Pressure A Hydraulic Supply (LPA) line into a primary hydraulic line and an existing Low Pressure B Hydraulic Supply (LPB) line into a pilot line and back up hydraulic supply line. Because the LPA line pressurizes critical control valve actuators at the subsea oil and gas well, the LPA line has a large volume of hydraulic fluid which would need to flow back towards the surface facility to close. Friction losses within the umbilical line prevent quick closure of the valves at the subsea oil and gas well. However, because the LPB line does not pressurize the critical control valve actuators, the volume of fluid needed to flow back to the surface facility is greatly reduced which allows for the pressure to drop at a faster rate than the LPA line. Thus, the LPB line quickly transmits the depressurization from the surface facility, and the retrievable quick dump valve quickly depressurizes the critical control valves such that the critical control valves are closed within the predetermined amount of time. Additionally, because the retrievable quick dump valve assembly will be packaged into a sandwich plate or logic cap that matches the existing multi quick coupler MQC plates, the quick dump valve assembly can be installed or retrofitted into the subsea oil and gas production system at various locations within the subsea oil and gas production system with minimal disruption. Moreover, because the retrievable and retrofittable subsea hydraulic dump valve assembly uses redundant hydraulic lines, the LPA line and the LPB line, to channel hydraulic fluid and transmit pressure changes at the surface facility, the sandwich plate can be quickly installed with low capital costs and minimal disruption to the subsea oil and gas production system. Furthermore, subsea production system safety systems are typically programed to vent both LPA and LPB lines when a loss of communication event occurs. The retrievable and retrofittable subsea hydraulic dump valve assemblies described herein quickly shut in the subsea wells without additions or modifications to topside control systems.

An exemplary technical effect of the methods, systems, and apparatus described herein includes at least one of: (a) closing control valves in a subsea oil and gas well; (b) reducing the time to close control valves in a subsea oil and gas well; and (c) improving environmental safety at a subsea oil and gas well; and (h) improving reliability of a subsea oil and gas well.

Exemplary embodiments of methods, systems, and apparatus for sandwich plates are not limited to the specific embodiments described herein, but rather, components of systems and/or steps of the methods may be utilized independently and separately from other components and/or steps described herein. For example, the methods may also be used in combination with other conventional and non-conventional control systems, and are not limited to practice with only the systems and methods as described herein. Rather, the exemplary embodiment can be implemented and utilized in connection with many other applications, equipment, and systems that may benefit from increased reliability and availability, and reduced maintenance and cost.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A retrievable and retrofittable subsea hydraulic dump valve assembly for a subsea oil and gas production system, the subsea oil and gas production system includes a first hydraulic pressure supply line, a second hydraulic pressure supply line, a plurality of critical control valve actuators, and a Subsea Control Module (SCM) hydraulic selector valve, the first hydraulic pressure supply line and the second hydraulic pressure supply line each channel a flow of hydraulic fluid to the SCM hydraulic selector valve, the SCM hydraulic selector valve selects one of the first hydraulic pressure supply line and the second hydraulic pressure supply line to channel the flow of hydraulic fluid to the critical control valve actuators to maintain the critical control valve actuators in an open configuration, the unselected hydraulic pressure supply line is a backup hydraulic pressure supply line for the critical control valve actuators, the critical control valve actuators are reconfigured into a closed configuration within a first reconfiguration time by depressurizing the first hydraulic pressure supply line and the second hydraulic pressure supply line, the retrievable and retrofittable subsea hydraulic dump valve assembly comprising:

at least one hydraulic selector valve including a solenoid and a spring, the hydraulic selector valve converts the first hydraulic pressure supply line into a primary hydraulic pressure supply line and the second hydraulic pressure supply line into a pilot line and the backup hydraulic pressure supply line, the second hydraulic pressure supply line channels a second flow of hydraulic fluid to the solenoid to reconfigure the hydraulic selector valve between a first operating configuration and a second operating configuration, wherein in the first operating configuration the hydraulic selector valve channels a first flow of hydraulic fluid from the first hydraulic pressure supply line to the critical control valve actuators to maintain the critical control valve actuators in the open configuration, and wherein in the second operating configuration the hydraulic selector valve channels the first flow of hydraulic fluid to the subsea environment at a local venting location to reconfigure the critical control valve actuators into a closed configuration, and wherein the retrievable and retrofittable subsea hydraulic dump valve assembly reconfigures the critical control valve actuators from the open configuration to the closed configuration within a second reconfiguration time less than the first reconfiguration time, and wherein in the first operating configuration the second hydraulic pressure supply line channels the second flow of hydraulic fluid to the solenoid and a hydraulic pressure of the second flow of hydraulic fluid acts on the spring to configure the hydraulic selector valve in the first operating configuration, and wherein in the second operating configuration the hydraulic pressure of the second flow of hydraulic fluid is reduced such that the spring reconfigures the hydraulic selector valve in the second operating configuration.

2. The retrievable and retrofittable subsea hydraulic dump valve assembly in accordance with claim 1, further comprising a first three-way valve and a second three-way valve, the first three-way valve coupled to the first hydraulic pressure supply line and the hydraulic selector valve, the second three-way valve coupled to a third hydraulic pressure supply line and the hydraulic selector valve, wherein in the first operating configuration the first three-way valve channels the first flow of hydraulic fluid from the first hydraulic pressure supply line to the hydraulic selector valve, and wherein in the first operating configuration the second three-way valve channels the first flow of hydraulic fluid from the hydraulic selector valve to the third hydraulic pressure supply line.

3. The retrievable and retrofittable subsea hydraulic dump valve assembly in accordance with claim 2, wherein in the second operating configuration the first three-way valve channels the first flow of hydraulic fluid from the first hydraulic pressure supply line to a cap of the hydraulic selector valve, and wherein in the second operating configuration the second three-way valve channels the first flow of hydraulic fluid from the third hydraulic pressure supply line to the hydraulic selector valve.

4. The retrievable and retrofittable subsea hydraulic dump valve assembly in accordance with claim 2 further comprising a fourth hydraulic pressure supply line coupled to the first three-way valve and the second three-way valve, wherein in a third operating configuration the first three-way valve channels the first flow of hydraulic fluid from the first hydraulic pressure supply line to the fourth hydraulic pressure supply line and the second three-way valve, and wherein in the third operating configuration the second three-way valve channels the first flow of hydraulic fluid from the fourth hydraulic pressure supply line to the third hydraulic pressure supply line.

5. The retrievable and retrofittable subsea hydraulic dump valve assembly in accordance with claim 1 wherein in the second operating configuration the hydraulic selector valve channels the first flow of hydraulic fluid from a third hydraulic pressure supply line to the environment to depressurize the third hydraulic pressure supply line.

6. The retrievable and retrofittable subsea hydraulic dump valve assembly in accordance with claim 5 further comprising a check valve coupled to the hydraulic selector valve, wherein in the second operating configuration the hydraulic selector valve channels the first flow of hydraulic fluid from the third hydraulic pressure supply line to the check valve and the check valve channels the first flow of hydraulic fluid to the environment to depressurize the third hydraulic pressure supply line.

7. The retrievable and retrofittable subsea hydraulic dump valve assembly in accordance with claim 6 further comprising a marine growth preventer coupled to the check valve and configured to prevent marine growth on the check valve.

8. The retrievable and retrofittable subsea hydraulic dump valve assembly in accordance with claim 1 further comprising an inboard multi quick connect plate configured to mate with an outboard multi quick connect plate of an adjacent component of the subsea oil and gas production system.

9. The retrievable and retrofittable subsea hydraulic dump valve assembly in accordance with claim 8, wherein the outboard multi quick connect plate of the adjacent component is configured to channel the first flow of hydraulic fluid and the second flow of hydraulic fluid to the inboard multi quick connect plate.

10. The retrievable and retrofittable subsea hydraulic dump valve assembly in accordance with claim 9, wherein the inboard multi quick connect plate is coupled to the first hydraulic pressure supply line and the second hydraulic pressure supply line, wherein the inboard multi quick connect plate channels the first flow of hydraulic fluid to the first hydraulic pressure supply line and the second flow of hydraulic fluid to the second hydraulic pressure supply line.

11. The retrievable and retrofittable subsea hydraulic dump valve assembly in accordance with claim 1 further comprising an outboard multi quick connect plate configured to mate with an inboard multi quick connect plate of an adjacent component of the subsea oil and gas production system.

12. The retrievable and retrofittable subsea hydraulic dump valve assembly in accordance with claim 11, wherein the outboard multi quick connect plate is configured to channel the first flow of hydraulic fluid to the inboard multi quick connect plate of the adjacent component.

13. The retrievable and retrofittable subsea hydraulic dump valve assembly in accordance with claim 12, wherein the outboard multi quick connect plate is coupled to the third hydraulic pressure supply line, wherein the third hydraulic pressure supply line channels the first flow of hydraulic fluid to the outboard multi quick connect plate.

14. A subsea oil and gas production system comprising:

a surface facility;

an umbilical including a first end coupled to the surface facility, the umbilical comprising a first hydraulic pressure supply line and a second hydraulic pressure supply line;

a subsea production system comprising:

at least one subsea tree coupled to a hydraulic distribution manifold and comprising at least one critical control valve actuator configured to control the flow of oil and gas from a well;

a Subsea Control Module (SCM) hydraulic selector valve, wherein the first hydraulic pressure supply line and the second hydraulic pressure supply line each channel a flow of hydraulic fluid to the SCM hydraulic selector valve, the SCM hydraulic selector valve selects one of the first hydraulic pressure supply line and the second hydraulic pressure supply line to channel the flow of hydraulic fluid to the at least one critical control valve actuator to maintain the at least one critical control valve actuator in an open configuration, the unselected hydraulic pressure supply line is a backup hydraulic pressure supply line for the at least one critical control valve actuator, the at least one critical control valve actuator are reconfigured into a closed configuration within a first reconfiguration time by depressurizing the first hydraulic pressure supply line and the second hydraulic pressure supply line, a retrievable and retrofittable subsea hydraulic dump valve assembly comprising:

at least one hydraulic selector valve including a solenoid, the hydraulic selector valve converts the first hydraulic pressure supply line into a primary hydraulic pressure supply line and the second hydraulic pressure supply line into a pilot line and the backup hydraulic pressure supply line, the second hydraulic pressure supply line channels a second flow of hydraulic fluid to the solenoid to reconfigure the hydraulic selector valve between a first operating configuration and a second operating configuration, wherein in the first operating configuration the hydraulic selector valve channels a first flow of hydraulic fluid from the first hydraulic pressure supply line to the at least one critical control valve actuator to maintain the at least one critical control valve actuator in the open configuration, and wherein in the second operating configuration the hydraulic selector valve channels the first flow of hydraulic fluid to the subsea environment at a local venting location to reconfigure the at least one critical control valve actuator into a closed configuration, and wherein the retrievable and retrofittable subsea hydraulic dump valve assembly reconfigures the at least one critical control valve actuator from the open configuration to the closed configuration within a second reconfiguration time less than the first reconfiguration time.

15. The subsea oil and gas production system in accordance with claim 14, wherein the retrievable and retrofittable subsea hydraulic dump valve assembly is coupled to an umbilical termination head.

16. The subsea oil and gas production system in accordance with claim 14, wherein the retrievable and retrofittable subsea hydraulic dump valve assembly is coupled to the subsea tree.

17. A retrievable and retrofittable subsea hydraulic dump valve assembly for a subsea oil and gas production system, the subsea oil and gas production system includes a first hydraulic pressure supply line, a second hydraulic pressure supply line, a plurality of critical control valve actuators, and a Subsea Control Module (SCM) hydraulic selector valve, the first hydraulic pressure supply line and the second hydraulic pressure supply line each channel a flow of hydraulic fluid to the SCM hydraulic selector valve, the SCM hydraulic selector valve selects one of the first hydraulic pressure supply line and the second hydraulic pressure supply line to channel the flow of hydraulic fluid to the critical control valve actuators to maintain the critical control valve actuators in an open configuration, the unselected hydraulic pressure supply line is a backup hydraulic pressure supply line for the critical control valve actuators, the critical control valve actuators are reconfigured into a closed configuration within a first reconfiguration time by depressurizing the first hydraulic pressure supply line and the second hydraulic pressure supply line, the retrievable and retrofittable subsea hydraulic dump valve assembly comprising:

a first hydraulic selector valve including a first solenoid and a first spring, the second hydraulic pressure supply line is coupled to the first hydraulic selector valve; and a second hydraulic selector valve including a second solenoid and a second spring, the first hydraulic pressure supply line is coupled to the second hydraulic selector valve;

a first isolation valve coupled to the first hydraulic pressure supply line and an inlet of the first hydraulic selector valve, wherein in a first operating configuration the first hydraulic pressure supply line channels a first flow of hydraulic fluid to the first isolation valve and to the second solenoid and the first isolation valve channels the first flow of hydraulic fluid to the inlet of the first hydraulic selector valve, and wherein in a second operating configuration the first isolation valve prevents the first flow of hydraulic fluid from flowing to the inlet of the first hydraulic selector valve; and a second isolation valve coupled to the second hydraulic pressure supply line and an inlet of the second hydraulic selector valve, wherein in the second operating configuration the second hydraulic pressure supply line channels a second flow of hydraulic fluid to the second isolation valve and to the first solenoid and the second isolation valve channels the second flow of hydraulic fluid to the inlet of the second hydraulic selector valve, and wherein in the first operating configuration the second isolation valve prevents the second flow of hydraulic fluid from flowing to the inlet of the second hydraulic selector valve;

wherein at least one of the first and second hydraulic selector valves converts at least one of the first and second hydraulic pressure supply lines into a primary hydraulic pressure supply line, and wherein at least one of the first and second hydraulic selector valves converts at least one of the first and second hydraulic pressure supply lines into a pilot line and a backup hydraulic pressure supply line, the second hydraulic pressure supply line channels the second flow of hydraulic fluid to the first solenoid to reconfigure the first hydraulic selector valve between the first operating configuration and the second operating configuration, the first hydraulic pressure supply line channels the first flow of hydraulic fluid to the second solenoid to reconfigure the second hydraulic selector valve between the first operating configuration and the second operating configuration, wherein in the first operating configuration the first hydraulic selector valve channels the first flow of hydraulic fluid from the first hydraulic pressure supply line to the subsea environment at a local venting location to reconfigure the critical control valve actuators into a closed configuration when the first and second hydraulic pressure supply lines are depressurized, and wherein in the second operating configuration the second hydraulic selector valve channels the second flow of hydraulic fluid from the second hydraulic pressure supply line to the subsea environment at a local venting location to reconfigure the critical control valve actuators into the closed configuration when the first and second hydraulic pressure supply lines are depressurized, and wherein the retrievable and retrofittable subsea hydraulic dump valve assembly reconfigures the critical control valve actuators from the open configuration to the closed configuration within a second reconfiguration time less than the first reconfiguration time, and wherein in the first operating configuration the second hydraulic pressure supply line channels the second flow of hydraulic fluid to the first hydraulic selector valve and a hydraulic pressure of the second flow of hydraulic fluid acts on the first spring to configure the first hydraulic selector valve in the first operating configuration, and wherein in the second operating configuration the hydraulic pressure of the second flow of hydraulic fluid is reduced such that the first spring reconfigures the first hydraulic selector valve in the second operating configuration, and and wherein in the second operating configuration the first hydraulic pressure supply line channels the first flow of hydraulic fluid to the second solenoid and a hydraulic pressure of the first flow of hydraulic fluid acts on the second spring to configure the second hydraulic selector valve in the second operating configuration, and wherein in the first operating configuration the hydraulic pressure of the first flow of hydraulic fluid is reduced such that the second spring reconfigures the second hydraulic selector valve in the first operating configuration.

18. The retrievable and retrofittable subsea hydraulic dump valve assembly in accordance with claim 17, wherein the retrievable and retrofittable subsea hydraulic dump valve assembly comprises a logic cap assembly.

19. The retrievable and retrofittable subsea hydraulic dump valve assembly in accordance with claim 17 further comprising an inboard multi quick connect plate configured to mate with an outboard multi quick connect plate of an adjacent component of the subsea oil and gas production system.

20. The retrievable and retrofittable subsea hydraulic dump valve assembly in accordance with claim 17 further comprising a third isolation valve coupled to an outlet of the first hydraulic selector valve and an outlet of the second hydraulic selector valve, wherein in the first operating configuration the third isolation valve channels the first flow of hydraulic fluid from the outlet of the first hydraulic selector valve to the subsea environment at the local venting location to reconfigure the critical control valve actuators into the closed configuration when the first and second hydraulic pressure supply lines are depressurized, and wherein in the second operating configuration the third isolation valve channels the second flow of hydraulic fluid from the outlet of the second hydraulic selector valve to the subsea environment at the local venting location to reconfigure the critical control valve actuators into the closed configuration when the first and second hydraulic pressure supply lines are depressurized.

* * * * *